US007908137B2

(12) United States Patent
Honda

(10) Patent No.: US 7,908,137 B2
(45) Date of Patent: Mar. 15, 2011

(54) SIGNAL PROCESSING DEVICE, SIGNAL PROCESSING METHOD, AND PROGRAM

(75) Inventor: Hitoshi Honda, Tokyo (JP)

(73) Assignee: Sony Corporation, Tokyo (JP)

( * ) Notice: Subject to any disclaimer, the term of this patent is extended or adjusted under 35 U.S.C. 154(b) by 949 days.

(21) Appl. No.: 11/760,095

(22) Filed: Jun. 8, 2007

(65) Prior Publication Data

US 2008/0015853 A1 Jan. 17, 2008

(30) Foreign Application Priority Data

Jun. 9, 2006 (JP) ..... 2006-160578

(51) Int. Cl.
*G10L 19/00* (2006.01)

(52) U.S. Cl. ..... 704/225; 704/217; 704/233; 375/354

(58) Field of Classification Search ..... 704/217, 704/225, 233; 375/354
See application file for complete search history.

(56) References Cited

U.S. PATENT DOCUMENTS

| | | | | |
|---|---|---|---|---|
| 6,055,499 | A | 4/2000 | Chengalvarayan et al. | |
| 2005/0015242 | A1* | 1/2005 | Gracie et al. | 704/211 |
| 2007/0110202 | A1* | 5/2007 | Casler et al. | 375/354 |
| 2008/0015853 | A1* | 1/2008 | Honda | 704/228 |
| 2008/0033718 | A1* | 2/2008 | Zopf et al. | 704/229 |

FOREIGN PATENT DOCUMENTS

| | | |
|---|---|---|
| JP | 58-23098 | 10/1983 |
| JP | 06-043892 | 2/1994 |
| JP | 09-212196 | 8/1997 |

OTHER PUBLICATIONS

Office Action from Japanese Patent Office dated May 23, 2008, for Application No. 2006-160578, 7 pages.
David L. Thomson et al., "Use of Voicing Features in HMM-Based Speech Recognition", Speech Communication, 2002, pp. 197-211, Elsevier Science B.V., USA.
Brian Kingsbury et al, "Robust Speech Recognition in Noisy Environments: The 2001 IBM Spine Evaluation System", IBM T.J Watson Research Center, 2002, pp. 53-56, USA.
Surnit Basu, "A Linked-HMM Model for Robust Voicing and Speech Detection", 2003, pp. 1-4, Microsoft Research.
Peter Veprek et al., "Analysis, Enhancement and Evaluation of Five Pitch Determination Techniques", Speech Communication, 2002 pp. 249-270, Elsevier Science B,V., USA.

(Continued)

*Primary Examiner* — Daniel D Abebe
(74) *Attorney, Agent, or Firm* — Finnegan, Henderson, Farabow, Garrett & Dunner, L.L.P.

(57) ABSTRACT

A signal processing device for processing an input signal includes gain calculating means and feature quantity calculating means. The gain calculating means is configured to obtain information indicating magnitude of noise to be added to the input signal on a basis of periodicity information indicating periodicity of the input signal and power of the input signal. The feature quantity calculating means is configured to obtain periodicity information of a noise-added signal obtained by adding noise having magnitude corresponding to the gain information to the input signal as a feature quantity of the input signal.

20 Claims, 26 Drawing Sheets

OTHER PUBLICATIONS

Alan de Cheveigné et al.. "YIN, A Fundamental Frequency Estimator for Speech and Music", J. Acoust. Soc. Am. 111 (4), Apr. 2002, pp. 1917-1930, Acoustical Society of America, USA.

András Zolnay et al., "Extraction Methods of Voicing Feature for Robust Speech Recognition", Human Language Technology and Pattern Recognition Chari of Computer Science VI, 2003, pp. 1-4, RWTH Aachen—University of Technology, Germany.

Françoise Beaufays, et al., "Using Speech/Non-Speech Detection to Bias Recognition Search on Noisy Data", Nuance Communications, 2003, pp. 1-4, USA.

Martin Graciarena et al., "Voicing Feature Integration In SRI's Decipher LVCSR System", Speech Technology and Research Laboratory, SRI International, 2004, pp. 921-924, USA.

* cited by examiner

FIG. 13

| SPEECH SECTION DETECTION PERFORMANCE [%] WHEN C INCREASING PERFORMANCE IN MUSIC ENVIRONMENT IS SELECTED | | | | |
|---|---|---|---|---|
| METHOD OF DETERMINING NOISE GAIN | VALUE OF C | NOISE TYPE | | |
| | | ROBOT | AIR CONDITIONER | MUSIC |
| CONVENTIONAL METHOD (BASELINE) | — | 94.63 | 93.12 | 8.75 |
| $\min(R_{max}(x(n)) \times p(n))$ | 0.4 | 94.12 | 96.25 | 45.00 |
| $\mathrm{ave}(R_{max}(x(n)) \times p(n))$ | 0.1 | 84.94 | 88.12 | 46.25 |
| $\min(p(n))$ | 0.2 | 89.80 | 93.12 | 45.00 |

FIG.14

| SPEECH SECTION DETECTION PERFORMANCE [%] WHEN C INCREASING PERFORMANCE IN ROBOT ENVIRONMENT AND AIR CONDITIONER NOISE ENVIRONMENT IS SELECTED | | | | |
|---|---|---|---|---|
| METHOD OF DETERMINING NOISE GAIN | VALUE OF C | NOISE TYPE | | |
| | | ROBOT | AIR CONDITIONER | MUSIC |
| CONVENTIONAL METHOD (BASELINE) | — | 94.63 | 93.12 | 8.75 |
| $\min(R_{max}(x(n)) \times p(n))$ | 0.2 | 94.78 | 96.25 | 42.50 |
| $\mathrm{ave}(R_{max}(x(n)) \times p(n))$ | 0.025 | 94.84 | 93.12 | 17.50 |
| $\min(p(n))$ | 0.05 | 93.98 | 96.25 | 13.75 |

MUSIC ENVIRONMENT C=0.2, N=40

AIR CONDITIONER ENVIRONMENT C=0.2, N=40

QRIO WALKING: C=0.2, N=40

QRIO HIGH-SPEED DANCING: C=0.2, N=40

SIGNAL PROCESSING DEVICE, SIGNAL PROCESSING METHOD, AND PROGRAM

CROSS REFERENCES TO RELATED APPLICATIONS

The present invention contains subject matter related to Japanese Patent Application JP 2006-160578 filed in the Japan Patent Office on Jun. 9, 2006, the entire contents of which being incorporated herein by reference.

BACKGROUND OF THE INVENTION

1. Field of the Invention

The present invention relates to a signal processing device, a signal processing method, and a program, and particularly to a signal processing device, a signal processing method, and a program that can obtain a feature quantity, for example autocorrelation or YIN that makes it possible to detect a section having periodicity in an input signal with high accuracy, for example.

2. Description of the Related Art

There is for example autocorrelation as periodicity information indicating periodicity of an audio signal. Autocorrelation is used as a feature quantity for picking up voiced sound of speech in speech recognition, detection of speech sections, and the like (see for example U.S. Pat. No. 6,055,499 (Patent Document 1 hereinafter) and Using of voicing features in HMM-based speech Recognition, D. L. Thomson, Chengalvarayan, Lucent, 2002 Speech Communication (Non-Patent Document 1), Robust Speech Recognition in Noisy Environments: The 2001 IBM Spine Evaluation System, B. Kingsbury, G. Saon, L. Mangu, M. Padmanabhan and R. Sarikaya, IBM, ICASSP2002 (Non-Patent Document 2), Extraction Methods for Voicing Feature for Robust Speech Recognition, Andras Zolnay, Ralf Schluter, and Hermann Ney, RWTH Aachen, EUROSPEECH 2003 (Non-Patent Document 3), USING SPEECH/NON-SPEECH DETECTION TO BIAS RECOGNITION SEARCH ON NOISY DATA, Francoise Beaufays, Daniel Boies, Mitch Weintraub, Qifeng Zhu, Nuance Communications, ICASSP2003 (Non-Patent Document 4), VOICING FEATURE INTEGRATION IN SRI'S DECIPHER LVSCR SYSTEM, Martin Graciarena, Horacio Franco, Jing Zheng, Dimitra Vergyri, Andreas Stolcke, SRI, ICASS2004 (Non-Patent Document 5), A LINKED-HMM MODEL FOR ROBUST VOICING AND SPEECH DETECTION, Sumit Basu, Microsoft Research, ICASSP2003 (Non-Patent Documents 6)). In addition, autocorrelation of an audio signal is used for detection of fundamental frequency (pitch frequency) of speech (see for example, Analysis, enhancement and evaluation of five pitch determination techniques, Peter Vapre, Michael S. Scordilis, Pansonic, Univ. Miami, Speech Communication 37(2002), pp. 249 to 270, referred to as Non-Patent Document 7).

In addition to autocorrelation, there is for example YIN recently proposed as periodicity information (see for example, YIN, a fundamental frequency estimator for speech and music, Alain de Chevigne', Hideki Kawahara, Japan Acoustic Society Am. 111 (4), April 2002, referred to as Non-Patent Document 8). YIN is used for detection of fundamental frequency of speech.

Autocorrelation is a high value when there is a high degree of periodicity, whereas autocorrelation is a value of zero when there is no periodicity. On the other hand, as opposed to autocorrelation, YIN is a value of zero when there is a high degree of periodicity, whereas YIN is a high value (1) when there is no periodicity. Description will hereinafter be made of a case where autocorrelation is used as periodicity information. However, when YIN is used as periodicity information, it suffices to use 1-YIN in place of normalized autocorrelation to be described later, or to read a maximum value of normalized autocorrelation as a minimum value of YIN and a read a minimum value of normalized autocorrelation as a maximum value of YIN.

While there are a number of kinds of methods for calculating autocorrelation, description will be made below of one of the methods.

A sample value at time t of the input signal of a time series samples at a predetermined sampling frequency will be expresses as X(t). A range of T samples for a fixed time T, that is, from a time t to a time t+T−1 will be referred to as a frame, and a time series of T sample values of an nth frame (number-n frame) from a start of the input signal will be described as a frame (or frame data) x(n).

The autocorrelation R'(x(n),τ) of the frame x(n) of the input signal X(t) can be calculated by Equation (1), for example.

[Equation 1] (1)

$$R'(x(n),\tau)=\frac{1}{T}\sum_{i=t}^{t+T-1-\tau}x[i]x[i+\tau]$$

The autocorrelation of a signal is a value indicating correlation between the signal and a signal obtained by shifting a same signal as the signal by a time τ. The time τ is referred to as a lag.

The autocorrelation R'(x(n),τ) of the frame x(n) may be obtained by subtracting an average value of T sample values X(t), X(t+1), . . . , and X(t+T−1) of the frame x(n) from the T sample values and using a result of subtraction in which the average value of the T sample values is zero, the result of subtraction being obtained as a result of subtracting the average value of the T sample values X(t), X(t+1), . . . , and X(t+T−1) of the frame x(n) from the T sample values.

Autocorrelation resulting from normalizing the autocorrelation R'(x(n),τ) obtained by Equation (1) is referred to as normalized autocorrelation.

When the autocorrelation resulting from normalizing the autocorrelation R'(x(n),τ) obtained by Equation (1) is expressed as R(x(n),τ), the normalized autocorrelation R(x(n),τ) is for example obtained by normalizing the autocorrelation R'(x(n),τ) of Equation (1) by autocorrelation R'(x(n),0) when the lag τ is zero, that is, calculating an equation R(x(n),τ)=R'(x(n),τ)/R'(x(n),0).

A maximum value of magnitude of the normalized autocorrelation R(x(n),τ) when the lag τ is changed is one when the input signal X(t) has perfect periodicity, that is, the input signal X(t) is a time series with a certain cycle $T_0$, and the cycle $T_0$ is equal to or less than the time length (frame length) T of the frame.

The normalized autocorrelation R(x(n),τ) is a value close to zero when the input signal X(t) does not have periodicity and the magnitude of the lag τ is substantially larger than zero. Incidentally, the normalized autocorrelation R(x(n),τ) is one when the lag τ is zero.

From the above, the normalized autocorrelation R(x(n),τ) can assume a value from −1 to +1.

Voiced sound of a human has a high degree of, if not perfect, periodicity.

FIG. 1 is a waveform chart showing an audio signal of voiced sound of a human. In FIG. 1, an axis of abscissas indicates time, and an axis of ordinates indicates the amplitude (level) of the audio signal.

It is clear from FIG. 1 that the audio signal of voiced sound of a human has periodicity. Incidentally, the audio signal of FIG. 1 is obtained by sampling at a sampling frequency of 16 kHz. The fundamental frequency of the audio signal of FIG. 1 is about 260 Hz (about 60 samples (≈16 kHz/260 Hz)).

The cycle (reciprocal of the cycle) of voiced sound of a human is referred to as fundamental frequency (pitch frequency). It is generally known that the fundamental frequency falls within a range of about 60 Hz to 400 Hz.

The range within which the fundamental frequency of voiced sound of a human falls will be referred to as a fundamental frequency range. When the normalized autocorrelation $R(x(n),\tau)$ is obtained with an audio signal of a human (an audio signal of speech of a human) used as the input signal X(t), a maximum value $R_{max}(x(n))$ of the normalized autocorrelation $R(x(n),\tau)$ in a range of the lag $\tau$ corresponding to the fundamental frequency range is a value close to one in an audio signal section of voiced sound having periodicity.

Supposing that the sampling frequency of the input signal X(t) is for example 16 kHz and that the fundamental frequency range is for example a range of 60 Hz to 400 Hz as described above, 60 Hz corresponds to about 266 samples (=16 kHz/60 Hz), and 400 Hz corresponds to about 40 samples (=16 kHz/400 Hz).

Thus, the range of the lag $\tau$ corresponding to the fundamental frequency range is substantially larger than zero. Therefore the maximum value $R_{max}(x(n))$ of the normalized autocorrelation $R(x(n),\tau)$ in the range of the lag $\tau$ corresponding to the fundamental frequency range is a value close to zero in a section without periodicity.

As described above, the maximum value $R_{max}(x(n))$ of the normalized autocorrelation $R(x(n),\tau)$ in the range of the lag $\tau$ corresponding to the fundamental frequency range theoretically has values significantly different from each other in a section with periodicity and a section without periodicity, and can thus be used as a feature quantity of the audio signal as the input signal X(t) in speech processing such as detection of speech sections, speech recognition, and the like.

FIG. 2 shows the audio signal as the input signal X(t) and various signals (information) obtained by processing the audio signal.

A first row from the top of FIG. 2 is a waveform chart of the audio signal as the input signal X(t). In the first row from the top of FIG. 2, an axis of abscissas indicates time (sample points), and an axis of ordinates indicates amplitude.

Incidentally, the audio signal X(t) in the first row from the top of FIG. 2 is obtained by sampling at a sampling frequency of 16 kHz.

A second row from the top of FIG. 2 shows a frequency spectrum obtained by subjecting the audio signal X(t) to an FFT (Fast Fourier Transform). In the second row from the top of FIG. 2, an axis of abscissas indicates time (frames), as an axis of ordinates indicates numbers for identifying so-called bins (frequency components) of the FFT.

Incidentally, because a 512-point (512-sample) FFT is performed as the FFT, one bin corresponds to about 32 Hz. In the second row from the top of FIG. 2, the magnitude of each frequency component is represented by shading.

A third row from the top of FIG. 2 shows the maximum value $R_{max}(x(n))$ of the normalized autocorrelation $R(x(n),\tau)$ of the input signal X(t) in the first row (the frame x(n) obtained from the input signal X(t) in the first row) in the range of the lag $\tau$ corresponding to the fundamental frequency range. In the third row from the top of FIG. 2, an axis of abscissas indicates time (frames), and an axis of ordinates indicates the maximum value $R_{max}(x(n))$.

The maximum value $R_{max}(x(n))$ of the normalized autocorrelation $R(x(n),\tau)$ in the range of the lag $\tau$ corresponding to the fundamental frequency range will hereinafter be referred to as lag range maximum correlation $R_{max}(x(n))$ as appropriate.

A fourth row from the top of FIG. 2 shows the power of the input signal X(t) in the first row (the frame x(n) obtained from the input signal X(t) in the first row), that is, a value as a log of a sum total of respective squares of the T sample values of the frame x(n) (which value will hereinafter be referred to as frame log power as appropriate). In the fourth row from the top of FIG. 2, an axis of abscissas indicates time (frames), and an axis of ordinates indicates the frame log power.

Parts enclosed by a rectangle in FIG. 2 represent a speech section. Specifically, parts enclosed by a first rectangle, a second rectangle, and a third rectangle from a left in FIG. 2 represent sections in which the utterances of "stop", "emergency stop", and "freeze" were made in Japanese.

The audio signal X(t) in the first row from the top of FIG. 2, the frequency spectrum in the second row, and the frame log power in the fourth row do not noticeably differ between the speech sections and non-speech sections. It is therefore understood that it is difficult to detect speech sections using the audio signal X(t), the frequency spectrum, or the frame log power.

On the other hand, the lag range maximum correlation $R_{max}(x(n))$ in the third row from the top of FIG. 2 is a value close to one in the speech sections, and is a value close to zero, which value is substantially lower than one, in the non-speech sections.

It is thus understood that the lag range maximum correlation $R_{max}(x(n))$ is a feature quantity effective in detecting speech sections.

SUMMARY OF THE INVENTION

The lag range maximum correlation $R_{max}(x(n))$ of the input signal X(t) can be a value close to one for sound other than voiced sound of a human, for example sound having periodicity (periodic noise).

It can therefore be difficult to distinguish a part of periodic noise and a part of voiced sound in the input signal X(t) from each other by the lag range maximum correlation $R_{max}(x(n))$ of the input signal X(t).

Non-Patent Document 6 describes a method that adds Gaussian noise to an input signal and detects a speech section using the lag range maximum correlation of the noise-added signal as the input signal to which the Gaussian noise is added.

Specifically, because the lag range maximum correlation of the Gaussian noise is close to zero, even when the input signal includes periodic noise, the lag range maximum correlation of a part of only the periodic noise of the noise-added signal obtained as a result of adding the Gaussian noise of a substantially higher level than that of the periodic noise to the input signal is a value close to zero due to effect of the Gaussian noise.

Thus, ideally, by adding Gaussian noise of high level to a part of only periodic noise (a part where there is no speech) of an input signal, it is possible to obtain the lag range maximum correlation that is a value close to zero in the part where there is no speech (the part of only the periodic noise) and which is a value close to one in a part where there is speech in the noise-added signal as the input signal to which the Gaussian noise is added.

When Gaussian noise of high level is added not only to a part where there is no speech but also to a part where there is speech in the input signal, the lag range maximum correlation of the noise-added signal to which the Gaussian noise is added is a value close to zero not only in the part where there is no speech but also in the part where there is speech. It thus becomes difficult to distinguish the part of periodic noise and the part of the speech (speech section) from each other.

Hence, when the lag range maximum correlation of the noise-added signal obtained by adding the Gaussian noise to the input signal is obtained, and the detection of a speech section or the like is performed using the lag range maximum correlation, it is important to adjust the level of the Gaussian noise added to the input signal properly, that is, increase the level of the Gaussian noise added to a part of the input signal in which part speech is not present and decrease the level of the Gaussian noise added to a part of the input signal in which part speech is present.

Non-Patent Document 6 describes a method that, as a process of a first stage, obtains a feature quantity using the autocorrelation of an input signal, roughly determines speech sections and non-speech sections, which are not speech sections, of the entire input signal on the basis of the feature quantity, and determines the level of Gaussian noise to be added to the input signal using the variance of the input signal in sections judged to be the non-speech sections, and as a process of a second stage, obtains a feature quantity using the autocorrelation of the noise-added signal obtained by adding the Gaussian noise having the level determined in the process of the first stage to the input signal as a feature quantity of the input signal, and finally determines speech sections and non-speech sections on the basis of the feature quantity.

However, in the process of the first stage, when based on the feature quantity using the autocorrelation of the input signal, the speech sections and the non-speech sections of the entire input signal may not be determined with high accuracy.

In the process of the first steps of the method described in Non-Patent Document 6, when the speech sections and the non-speech sections are erroneously determined on the basis of the feature quantity using the autocorrelation of the input signal, an inappropriate level is determined as the level of the Gaussian noise to be added to the input signal. As a result, in the process of the second stage, the final determination of speech section and non-speech sections which determination is made on the basis of the feature quantity using the autocorrelation of the noise-added signal also becomes inaccurate. It consequently becomes difficult to detect speech sections, particularly sections having periodicity such as parts of voiced sound or the like, with high accuracy.

The present invention has been made in view of such a situation, and it is desirable to obtain autocorrelation that can for example detect a section having periodicity in an input signal with high accuracy.

A signal processing device according to an embodiment of the present invention is a signal processing device for processing an input signal, the signal processing device including: gain calculating means for obtaining gain information indicating magnitude of noise to be added to the input signal on a basis of periodicity information indicating periodicity of the input signal and power of the input signal; and feature quantity calculating means for obtaining periodicity information of a noise-added signal obtained by adding noise having magnitude corresponding to the gain information to the input signal as a feature quantity of the input signal.

A signal processing method or a program according to an embodiment of the present invention is a signal processing method of a signal processing device for processing an input signal, or a program for making a computer perform signal processing that processes an input signal, the signal processing method or the program including the steps of: obtaining gain information indicating magnitude of noise to be added to the input signal on a basis of periodicity information indicating periodicity of the input signal and power of the input signal; and obtaining periodicity information of a noise-added signal obtained by adding noise having magnitude corresponding to the gain information to the input signal as a feature quantity of the input signal.

In the above-described embodiments of the present invention, gain information indicating magnitude of noise to be added to the input signal is obtained on a basis of periodicity information of the input signal and power of the input signal, and periodicity information of a noise-added signal obtained by adding noise having magnitude corresponding to the gain information to the input signal is obtained as a feature quantity of the input signal.

According to the above-described embodiments of the present invention, it is possible to obtain periodicity information that can for example detect a section having periodicity in an input signal with high accuracy.

BRIEF DESCRIPTION OF THE DRAWINGS

FIG. 13 is a diagram showing rates of correct detection of speech sections obtained in an experiment;

FIG. 14 is a diagram showing rates of correct detection of speech sections obtained in an experiment;

DETAILED DESCRIPTION OF THE PREFERRED EMBODIMENTS

Figure 1:
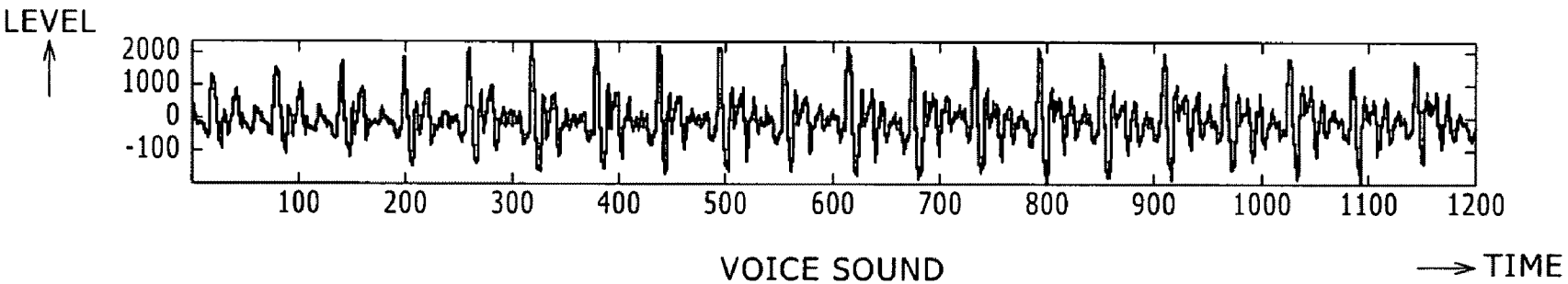
FIG. 1 is a waveform chart showing an audio signal.
Figure 2:
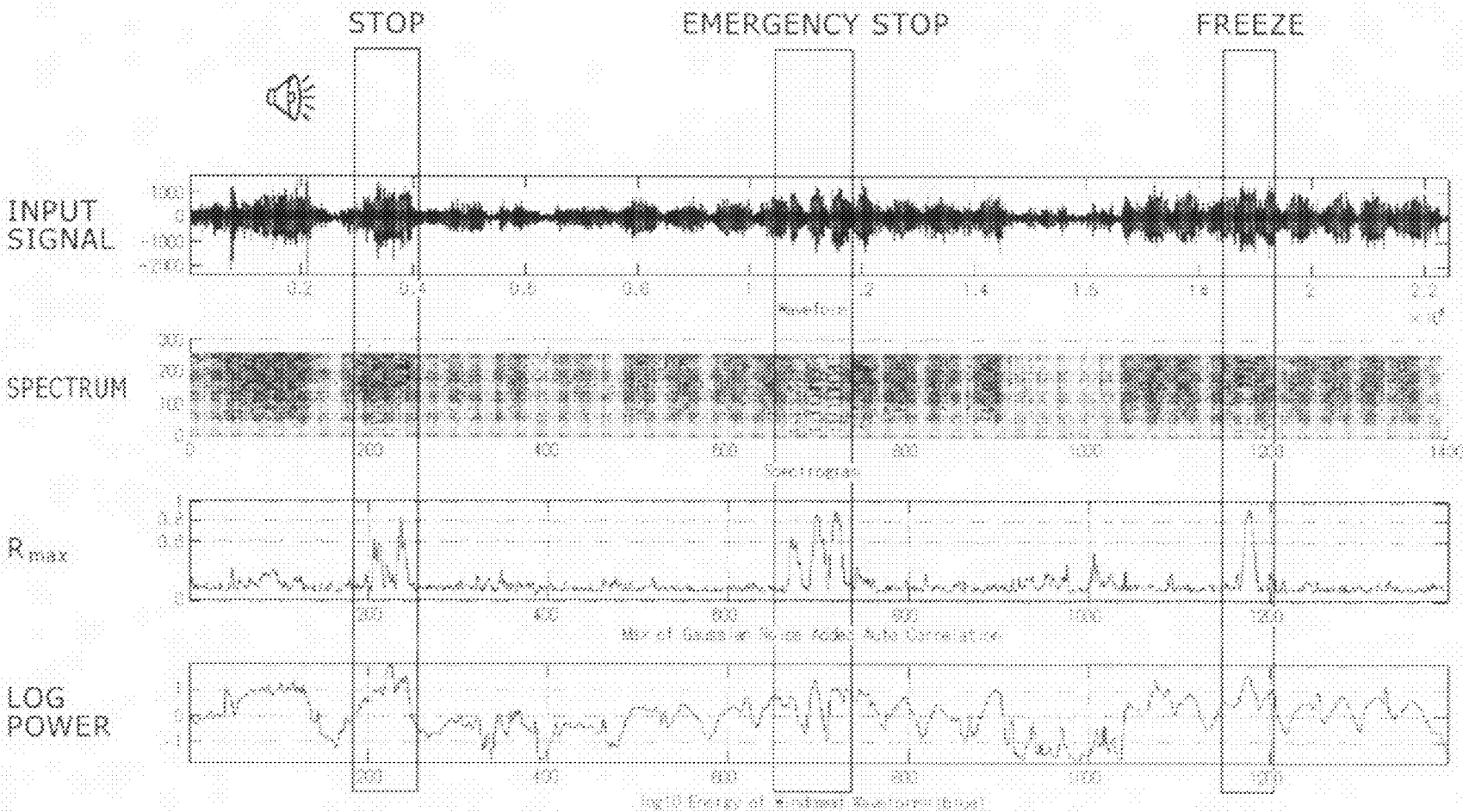
FIG. 2 is a diagram showing information obtained by processing an audio signal.

Preferred embodiments of the present invention will hereinafter be described. Correspondence between constitutional requirements of the present invention and embodiments described in the specification or the drawings are illustrated as follows. This description is to confirm that embodiments supporting the present invention are described in the specification or the drawings. Therefore, even when there is an embodiment described in the specification or drawings but not described here as an embodiment corresponding to a constitutional requirement of the present invention, it does not signify that the embodiment does not correspond to the constitutional requirement. Conversely, even when an embodiment is described here as corresponding to a constitutional requirement, it does not signify that the embodiment does not correspond to constitutional requirements other than that constitutional requirement.

A signal processing device according to an embodiment of the present invention is a signal processing device for processing an input signal, the signal processing device including gain calculating means and feature quantity calculating means. The gain calculating means (for example a gain calculating unit 16 in FIG. 3) is configured to obtain gain information indicating magnitude of noise to be added to the input signal on a basis of periodicity information indicating periodicity of the input signal and power of the input signal. The feature quantity calculating means (for example $R_{max}$ calculating unit 20 in FIG. 3 or an $R_{max}$ approximate calculating unit 92 in FIG. 20) is configured to obtain periodicity information of a noise-added signal obtained by adding noise having magnitude corresponding to the gain information to the input signal as a feature quantity of the input signal.

The signal processing device according to the foregoing embodiment of the present invention can further include: noise generating means (for example a noise generating unit 71 in FIG. 18) for generating a plurality of noises; and noise selecting means (for example a noise selecting unit 74 in FIG. 18) for selecting a noise to be added to the input signal from the plurality of noises on a basis of periodicity information of the noises.

The signal processing device according to the foregoing embodiment of the present invention can further include processing means (for example a determination processing unit 47 in FIG. 5) for performing predetermined processing on a basis of the feature quantity of the input signal.

When the feature quantity calculating means obtains the feature quantity of the input signal for each frame having a fixed time length, the signal processing device can further include plural frame processing means (for example a plural frame processing unit 45 in FIG. 5) for obtaining an integrated feature quantity of a plurality of dimensions, the integrated feature quantity being obtained by integrating feature quantities of the plurality of frames, and the processing means can perform the predetermined processing on a basis of the integrated feature quantity.

The signal processing device according to the foregoing embodiment of the present invention can further include linear discriminant analysis means (for example a linear discriminant analysis unit 46 in FIG. 5) for compressing the dimensions of the integrated feature quantity by linear discriminant analysis, and the processing means can perform the predetermined processing on a basis of the integrated feature quantity of the compressed dimensions.

Figure 19:
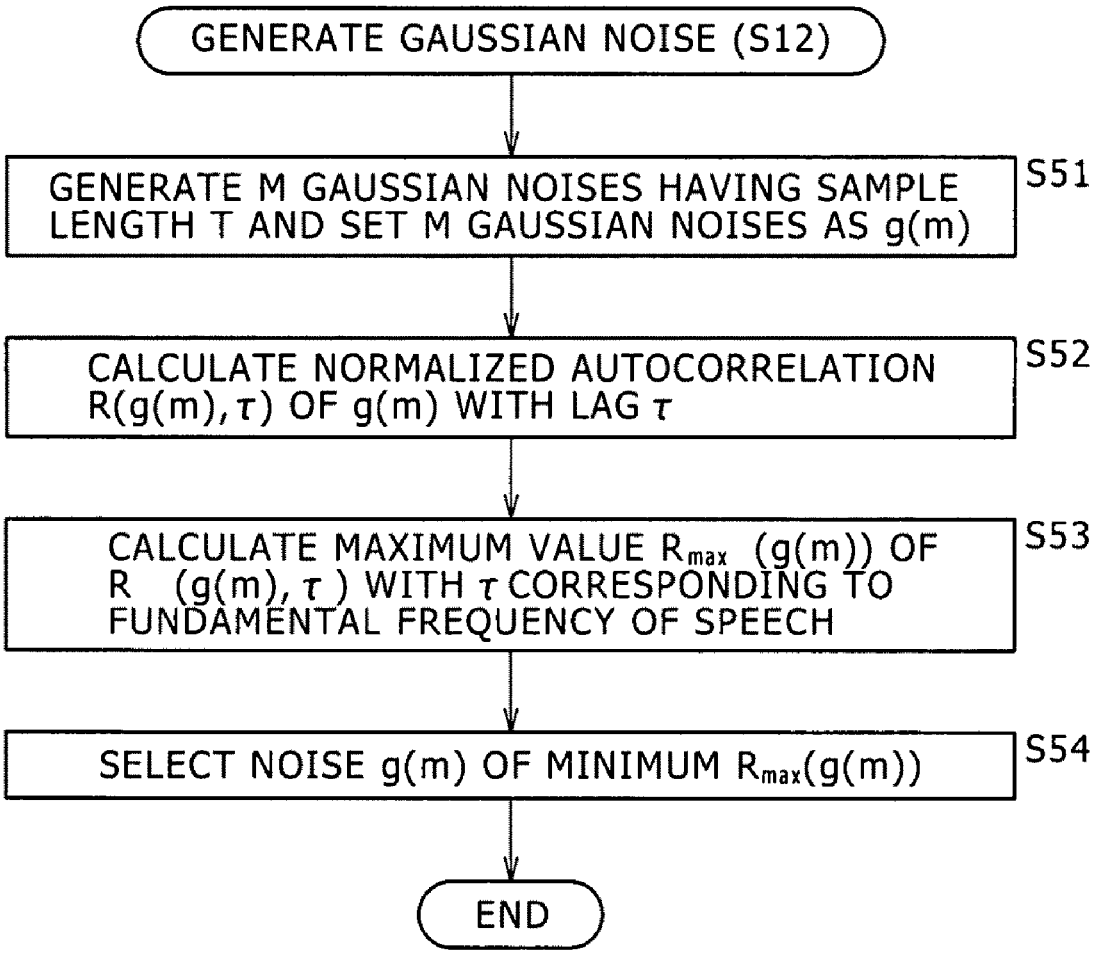
FIG. 19 is a flowchart of assistance in explaining a process of the Gaussian noise generating unit 17.
Figure 21:
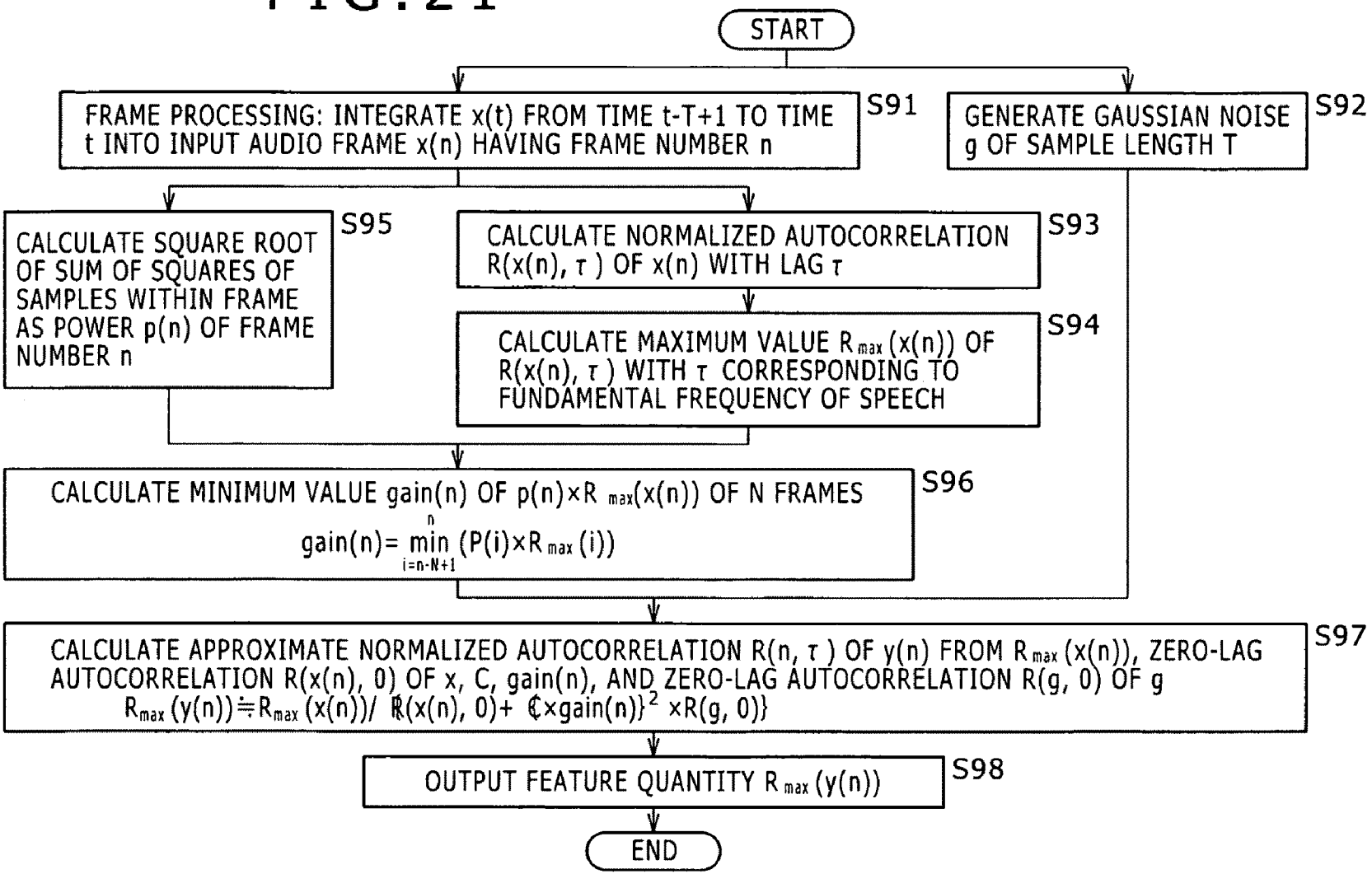
FIG. 21 is a flow chart of assistance in explaining the operation of the signal processing device.

A signal processing method or a program according to an embodiment of the present invention is a signal processing method of a signal processing device for processing an input signal, or a program for making a computer perform signal processing that processes an input signal, the signal processing method or the program including the steps of: obtaining gain information indicating magnitude of noise to be added to the input signal on a basis of periodicity information indicating periodicity of the input signal and power of the input signal (for example step S16 in FIG. 4); and obtaining periodicity information of a noise-added signal obtained by adding noise having magnitude corresponding to the gain information to the input signal as a feature quantity of the input signal (for example steps S18 and S19 in FIG. 19 or step S97 in FIG. 21).

Preferred embodiments of the present invention will hereinafter be described with reference to the drawings.

Figure 3:
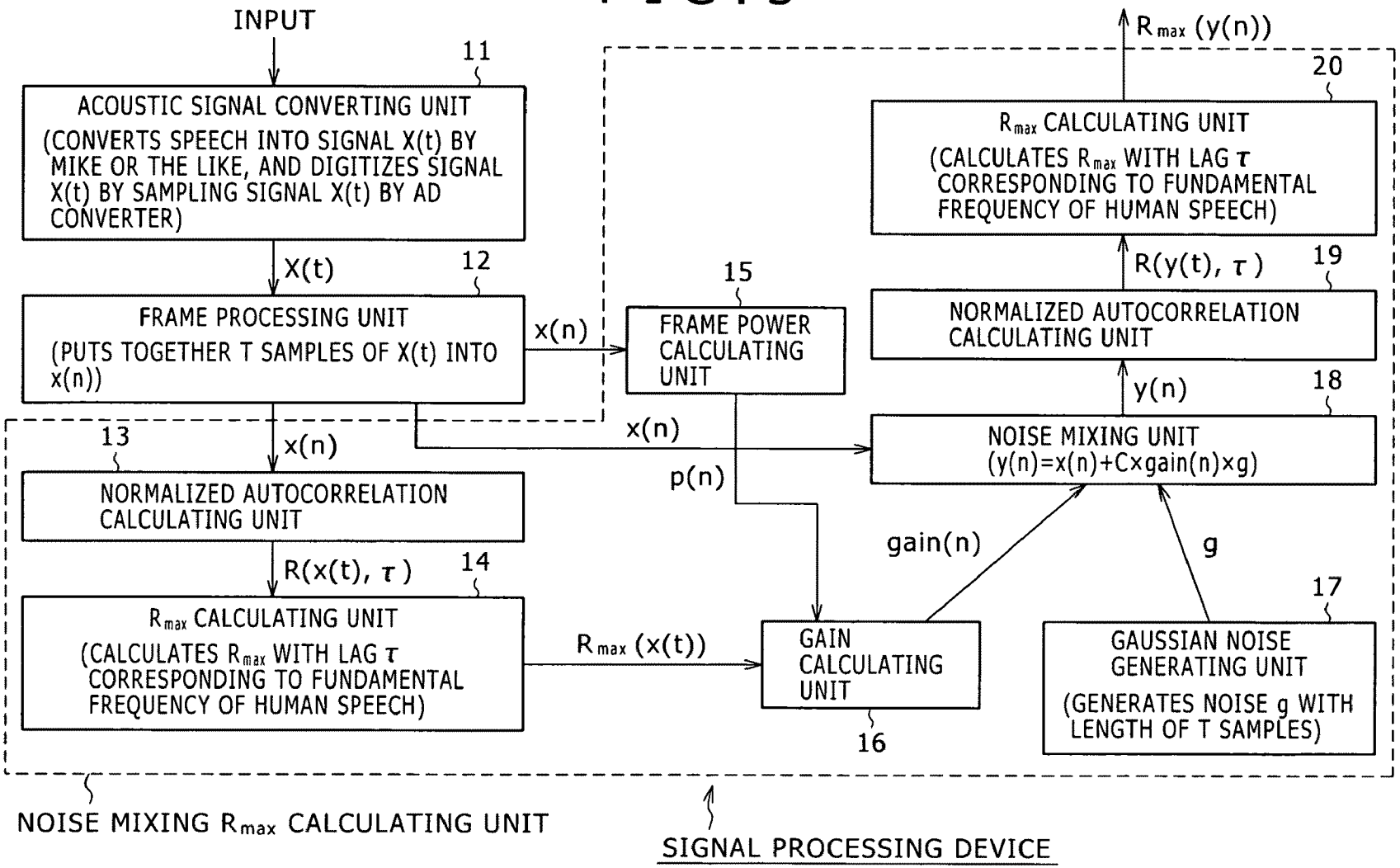
FIG. 3 is a block diagram showing an example of configuration of an embodiment of a signal processing device to which the present invention is applied.

FIG. 3 is a block diagram showing an example of configuration of an embodiment of a signal processing device to which the present invention is applied.

The signal processing device of FIG. 3 obtains gain information indicating magnitude of noise to be added to an input signal from the input signal, and obtains autocorrelation of a noise-added signal obtained by adding noise having magnitude (level) corresponding to the gain information to the input signal as a feature quantity of the input signal.

Specifically, the signal processing device in FIG. 3 includes an acoustic signal converting unit 11, a frame processing unit 12, a normalized autocorrelation calculating unit 13, an $R_{max}$ calculating unit 14, a frame power calculating unit 15, a gain calculating unit 16, a Gaussian noise generating unit 17, a noise mixing unit 18, a normalized autocorrelation calculating unit 19, and an $R_{max}$ calculating unit 20.

The acoustic signal converting unit 11 is for example formed by a mike (microphone) and an A/D (Analog/Digital) converter. The acoustic signal converting unit 11 converts speech into a digital audio signal, and then supplies the digital audio signal to the frame processing unit 12.

Specifically, the acoustic signal converting unit 11 converts sound as air vibrations input thereto (the speech of a human and sound present in an environment where the signal processing device is installed) into an analog audio signal by the mike. The acoustic signal converting unit 11 further converts the analog audio signal obtained by the mike into a digital audio signal by the A/D converter. The acoustic signal converting unit 11 supplies the audio signal as an input signal in time series to the frame processing unit 12. A sample value of the input signal at time t will hereinafter be expressed as X(t).

The frame processing unit 12 performs frame processing that converts the input signal X(t) supplied from the acoustic signal converting unit 11 into a frame including sample values of T samples, that is, for example converts T sample values X(t−T+1), X(t−T+2), . . . , and X(t) of the input signal from time t−T+1 to time t into one frame, converts T sample values of the input signal from a start time later than time t−T+1 by a predetermined frame shift time into one frame, and thereafter similarly forms frames from the input signal X(t) supplied from the acoustic signal converting unit 11. The frame processing unit 12 supplies the frames to the normalized autocorrelation calculating unit 13, the frame power calculating unit 15, and the noise mixing unit 18.

An nth frame is (a frame having a frame number n) from a start of the input signal X(t) will hereinafter be referred to as a frame x(n) as appropriate.

The normalized autocorrelation calculating unit 13 obtains autocorrelation R'(x(n),τ) of the frame x(n) supplied from the frame processing unit 12 according to the above-described Equation (1), for example. The normalized autocorrelation calculating unit 13 further obtains normalized autocorrelation R(x(n),τ) by normalizing the autocorrelation R'(x(n),τ).

The normalized autocorrelation R(x(n),τ) and the autocorrelation R'(x(n),τ) before being normalized into the autocorrelation R(x(n),τ) are both "autocorrelation". Incidentally, the autocorrelation R'(x(n),τ) before being normalized will hereinafter be referred to as pre-normalization autocorrelation as appropriate.

As described above, the normalized autocorrelation R(x(n),τ) can be obtained by normalizing the pre-normalization autocorrelation R'(x(n),τ) by pre-normalization autocorrelation R'(x(n),0) with a lag τ of zero, that is, calculating the equation R(x(n),τ)=R'(x(n),τ)/R'(x(n),0).

After obtaining the normalized autocorrelation R'(x(n),τ) of the frame x(n), the normalized autocorrelation calculating unit 13 supplies the normalized autocorrelation R(x(n),τ) to the $R_{max}$ calculating unit 14.

The $R_{max}$ calculating unit 14 for example set a range of frequencies from 80 Hz to 400 Hz as a fundamental frequency range. The $R_{max}$ calculating unit 14 obtains a lag range maximum correlation $R_{max}$(x(n) as a maximum value of the normalized autocorrelation R(x(n),τ) in a range of the lag τ corresponding to the fundamental frequency range, the normalized autocorrelation R(x(n),τ) being supplied from the normalized autocorrelation calculating unit 13. The $R_{max}$ calculating unit 14 then supplies the lag range maximum correlation $R_{max}$(x(n)) to the gain calculating unit 16.

As described above, when the fundamental frequency range is a range of frequencies from 80 Hz to 400 Hz, and a sampling frequency at which the input signal X(t) is sampled by the acoustic signal converting unit 11 is for example 16 kHz, the range of the lag τ corresponding to the fundamental frequency range is a range from 40 samples (=16 kHz/400 Hz) to 200 samples (=16 kHz/80 Hz). In this case, the $R_{max}$ calculating unit 14 obtains a maximum normalized autocorrelation R'(x(n),τ) with the lag τ in the range from 40 samples to 200 samples, and sets the maximum normalized autocorrelation R(x(n),τ) as the lag range maximum correlation $R_{max}$(x(n)).

The frame power calculating unit 15 obtains power p(n) of the frame x(n) supplied from the frame processing unit 12 (which power will hereinafter be referred to as frame power as appropriate). The frame power calculating unit 15 then supplies the frame power p(n) to the gain calculating unit 16.

In this case, the frame power calculating unit 15 for example calculates a sum total of respective squares of the T sample values of the frame x(n), or a square root of the sum total. The frame power calculating unit 15 sets a result of the calculation as the frame power p(n).

The gain calculating unit 16 obtains a gain gain(n) as gain information indicating magnitude of noise to be added to the frame x(n) (each sample value of the frame x(n)) of the input signal X(t) on the basis of the lag range maximum correlation $R_{max}$(x(n)) of the frame x(n) as autocorrelation of the input signal X(t), the lag range maximum correlation $R_{max}$(x(n)) being supplied from the $R_{max}$ calculating unit 14, and the frame power p(n) of the frame x(n) as power of the input signal X(t), the frame power p(n) being supplied from the frame power calculating unit 15. The gain calculating unit 16 supplies the gain(n) to the noise mixing unit 18.

Specifically, the gain calculating unit 16 for example calculates a predetermined function F(p(n),$R_{max}$(x(n))) having, as arguments, the lag range maximum correlation $R_{max}$(x(n)) of the frame x(n) from the $R_{max}$ calculating unit 14 and the frame power p(n) of the frame x(n) from the frame power calculating unit 15. The gain calculating unit 16 supplies a result of the calculation as the gain(n) to the noise mixing unit 18.

In this case, it is possible to use, as the function F(p(n), $R_{max}$(x(n))) for obtaining the gain(n), for example a function for obtaining a minimum value of products p(n)×$R_{max}$(x(n)) of the frame powers p(n) and the lag range maximum correlations $R_{max}$(x(n)) of N consecutive frames (N is an integer of two or more), respectively, including the frame x(n) (a produce p(n)×$R_{max}$(x(n)) having a maximum value among the products p(n)×$R_{max}$(x(n)) of the N respective frames).

The Gaussian noise generating unit 17 generates Gaussian noise of T samples equal in number to that of samples of one frame as noise g to be added to the frame x(n) of the input signal X(t). The Gaussian noise generating unit 17 supplies the noise g to the noise mixing unit 18.

Incidentally, the noise g generated by the Gaussian noise generating unit 17 is not limited to Gaussian noise, and may be any noise as long as the lag range maximum correlation $R_{max}$(g) of the noise g is a value of zero or close to zero.

The noise mixing unit 18 obtains a noise-added signal obtained by adding noise having magnitude corresponding to the gain(n) from the gain calculating unit 16 to the frame x(n) of the input signal X(t) from the frame processing unit 12. The noise mixing unit 18 then supplies the noise-added signal to the normalized autocorrelation calculating unit 19.

Specifically, the noise mixing unit 18 converts the noise g from the Gaussian noise generating unit 17 into noise having magnitude corresponding to the gain(n) from the gain calculating unit 16 (which noise will hereinafter be referred to as level converted noise as appropriate). The noise mixing unit 18 obtains a frame y(n) of a noise-added signal Y(t) obtained by adding the level converted noise to the frame x(n) of the input signal X(t) from the frame processing unit 12. The noise mixing unit 18 supplies the frame y(n) of the noise-added signal Y(t) to the normalized autocorrelation calculating unit 19.

In this case, when the level converted noise at time t is expressed as B(t) and the noise-added signal at time t is expressed as Y(t), a signal X(t)+B(t) obtained by adding the level converted noise B(t) to the input signal X(t) is the noise-added signal Y(t).

When an nth frame (a time series of T sample values of the nth frame) from a start of the noise-added signal Y(t) is expressed as y(n), the noise mixing unit 18 obtains the frame y(n) of the noise-added signal Y(t) according to an equation y(n)=x(n)+C×gain(n)×g, for example, where C is a predetermined appropriate constant.

As with the above-described normalized autocorrelation calculating unit 13, the normalized autocorrelation calculating unit 19 obtains pre-normalization autocorrelation R'(y(n),τ) of the frame y(n) of the noise-added signal Y(t) from the noise mixing unit 18. The normalized autocorrelation calculating unit 19 further obtains normalized autocorrelation R(y(n),τ) by normalizing the pre-normalization autocorrelation R'(y(n),τ). The normalized autocorrelation calculating unit 19 then supplies the normalized autocorrelation R(y(n),τ) to the $R_{max}$ calculating unit 20.

As with the $R_{max}$ calculating unit 14, the $R_{max}$ calculating unit 20 for example sets a range of frequencies from 80 Hz to 400 Hz as a fundamental frequency range. The $R_{max}$ calculating unit 20 obtains a lag range maximum correlation $R_{max}$(y(n)) as a maximum value of the normalized autocorrelation R(y(n),τ) of the noise-added signal Y(t) in a range of the lag τ corresponding to the fundamental frequency range, the normalized autocorrelation R(y(n),τ) being supplied from the normalized autocorrelation calculating unit 19. The $R_{max}$ calculating unit 20 then outputs the lag range maximum correlation $R_{max}$(y(n)) as a feature quantity extracted from the frame x(n) of the input signal X(t).

Incidentally, in the signal processing device of FIG. 3, the normalized autocorrelation calculating unit 13, the $R_{max}$ calculating unit 14, the frame power calculating unit 15, the gain calculating unit 16, the Gaussian noise generating unit 17, the noise mixing unit 18, the normalized autocorrelation calculating unit 19, and the $R_{max}$ calculating unit 20 form a noise mixing Rmax calculating unit for obtaining the lag range maximum correlation $R_{max}$(y(n)) of the noise-added signal Y(t) as a feature quantity of the frame x(n) from the frame x(n). A process of obtaining the lag range maximum correlation $R_{max}$(y(n)) of the noise-added signal Y(t) which process is performed in the noise mixing Rmax calculating unit will hereinafter be referred to as a noise mixing Rmax calculating process as appropriate.

As described above, when the lag range maximum correlation $R_{max}$(y(n)) of the noise-added signal Y(t) obtained by adding Gaussian noise to the input signal X(t) is obtained, and the detection of a speech section or the like is performed using the lag range maximum correlation $R_{max}$(y(n)), it is important to adjust the level of the Gaussian noise added to the input signal X(t) properly, that is, increase the level of the Gaussian noise added to a part of the input signal X(t) in which part speech is not present and decrease the level of the Gaussian noise added to a part of the input signal X(t) in which part speech is present.

As described above, the noise mixing unit 18 in the signal processing device of FIG. 3 obtains the frame y(n) of the noise-added signal Y(t) according to the equation y(n)=x(n)+C×gain(n)×g. That is, the noise mixing unit 18 obtains the frame y(n) of the noise-added signal Y(t) by adding the noise C×gain(n)×g having magnitude proportional to the gain gain(n) to the frame of the input signal X(t).

Hence, it is necessary to increase the gain gain(n) when the frame x(n) of the input signal X(t) is not a speech section frame, and decreases the gain gain(n) when the frame x(n) of the input signal X(t) is a speech section frame. The gain calculating unit 16 uses a function from which the gain gain(n) as described above can be obtained as the function F(p(n), $R_{max}$(x(n))) for obtaining the gain gain(n).

As described in a document "CONSTRUCTION AND EVALUATION OF A ROBUST MULTIFEATURE SPEECH/MUSIC DISCRIMINATOR", Eric Scheirer, Malcolm Slaney, ICASSP '97, pp. 1331 to 1334, it is known that as compared with music (musical piece), for example, a higher percentage of the frame of human speech have frame power lower than an average value of frame power (average frame power) in a section of about one second, that is, many of the frames of human speech have frame power lower than the average frame power.

Further, as described in the above document, it is known that the spectrum of human speech changes at about 4 Hz (0.25 seconds).

Thus, for speech, there can be expected to be a change in power and normalized autocorrelation within a time of a few hundred milliseconds (a few tenths of a second) to about one second.

Specifically, for speech, there can be expected to be a part where power varies greatly and a part where autocorrelation varies greatly within a time of a few hundred milliseconds to about one second. Hence, for speech, it can be expected that the produce p(n)×$R_{max}$(x(n)) of the frame power p(n) and the normalized autocorrelation $R_{max}$(x(n)), for example, as a value calculated from power and autocorrelation varies greatly and has a low value within a time of a few hundred milliseconds to about one second.

On the other hand, for music or other stationary noise, there may not be expected to be a part where power varies greatly within a time of a few hundred milliseconds to about one second. Further, the autocorrelation of stationary noise is uniformly high. Hence, for stationary noise, the above-described product p(n)×$R_{max}$(x(n)) of the frame power p(n) and the normalized autocorrelation $R_{max}$(x(n)), for example, may not be expected to vary greatly within a time of a few hundred milliseconds to about one second. Further, the product p(n)×$R_{max}$(x(n)) of the frame power p(n) and the normalized autocorrelation $R_{max}$(x(n)) can be expected to have a relatively high value due to effect of the normalized autocorrelation $R_{max}$(x(n)) in particular.

Accordingly, by using a minimum value of the product p(n)×$R_{max}$(x(n)) of the frame power p(n) and the normalized autocorrelation $R_{max}$(x(n)), for example, within a time of a few hundred milliseconds to about one second, the function F(p(n),$R_{max}$(x(n))) for obtaining the gain gain(n) can be expected to provide a gain gain(n) having a low value for speech (frame x(n) of speech) and provide a gain gain(n) having a high value for stationary noise (frame x(n) of stationary noise).

It is to be noted that the function F( ) for obtaining the gain gain(n) is not limited to the above-described function. That is, the function F( ) for obtaining the gain gain(n) may be any function as long as the function heightens the lag range maximum correlation $R_{max}$(y(n)) obtained for a frame of speech section in the $R_{max}$ calculating unit 20 and lowers the lag range maximum correlation $R_{max}$(y(n)) obtained for a frame of a non-speech section.

The constant C used to obtain the frame y(n) of the noise-added signal Y(t) according to the equation y(n)=x(n)+C×gain(n)×g in the noise mixing unit 18 can assume a value when speech sections can be detected most accurately in an experiment in which for example the lag range maximum correlation $R_{max}$(y(n)) of the noise-added signal Y(t) is obtained while changing the value of the constant C and speech sections are detected using the lag range maximum correlation $R_{max}$(y(n)).

In addition, the constant C used in the noise mixing unit 18 can assume a value of the constant C when the lag range maximum correlation $R_{max}$(y(n)) having a high value for a speech section and a low value for a non-speech section is obtained in a case where the lag range maximum correlation $R_{max}$(y(n)) of the noise-added signal Y(t) is obtained while changing the value of the constant C and the lag range maximum correlation $R_{max}$(y(n)) is plotted and then checked visually.

The operation of the signal processing device of FIG. 3 will next be described with reference to a flowchart of FIG. 4.

In the signal processing device of FIG. 3, an audio signal as input signal X(t) is supplied from the acoustic signal converting unit 11 to the frame processing unit 12.

In step S11, the frame processing unit 12 performs frame processing that converts the input signal X(t) supplied from the acoustic signal converting unit 11 into a frame including sample values of T samples. The frame processing unit 12 supplies the frame x(n) obtained as a result of the frame processing to the normalized autocorrelation calculating unit 13, the frame power calculating unit 15, and the noise mixing unit 18.

In step S13, the normalized autocorrelation calculating unit 13 obtains normalized autocorrelation R(x(n),τ) of the time x(n) from the frame processing unit 12. The normalized autocorrelation calculating unit 13 supplies the normalized autocorrelation R(x(n),τ) to the $R_{max}$ calculating unit 14.

In step S14, the $R_{max}$ calculating unit 14 obtains a lag range maximum correlation $R_{max}$(x(n)) as a maximum value of the normalized autocorrelation R(x(n),τ) in a range of the lag τ corresponding to the fundamental frequency range, the normalized autocorrelation R(x(n),τ) being supplied from the normalized autocorrelation calculating unit 13. The $R_{max}$ calculating unit 14 then supplies the lag range maximum correlation $R_{max}$(x(n)) to the gain calculating unit 16.

In step S15, the frame power calculating unit 15 obtains frame power p(n) of the frame x(n) from the frame processing unit 12. The frame power calculating unit 15 then supplies the frame power p(n) of the frame x(n) to the gain calculating unit 16.

In step S16, the gain calculating unit 16 obtains gain gain (n) on the basis of the lag range maximum correlation $R_{max}$ (x(n)) of the frame x(n) from the $R_{max}$ calculating unit 14 and the frame power p(n) of the frame x(n) from the frame power calculating unit 15. The gain calculating unit 16 then supplies the gain gain(n) to the noise mixing unit 18.

Specifically, the gain calculating unit 16 for example obtains, as the gain gain(n), a minimum value of the products p(n)×$R_{max}$(x(n)) of the frame powers p(n) and the lag range maximum correlations $R_{max}$(x(n)) of N frames present within a time of a few hundred milliseconds to about one second with the frame x(n) as a center. The gain calculating unit 16 then supplies the gain gain(n) to the noise mixing unit 18.

Meanwhile, in step S12, the Gaussian noise generating unit 17 generates Gaussian noise g of T samples equal in number to that of samples of one frame. The Gaussian noise generating unit 17 supplies the Gaussian noise g to the noise mixing unit 18.

In step S17, according to the equation y(n)=x(n)+C×gain (n)×g, the noise mixing unit 18 obtains a product C×gain(n) of the constant C and the gain gain(n) from the gain calculating unit 16, and obtains noise C×gain(n)×g by multiplying the Gaussian noise g from the Gaussian noise generating unit 17 by the product C×gain(n). Further, in step S17, according to the equation y(n)=x(n)+×gain(n)×g, the noise mixing unit 18 obtains a frame y(n) of a noise-added signal Y(t) by adding the noise C×gain(n)×g to the frame x(n) from the frame processing unit 12. The noise mixing unit 18 supplies the frame y(n) of the noise-added signal Y(t) to the normalized autocorrelation calculating unit 19.

In step S18, the normalized autocorrelation calculating unit 19 obtains normalized autocorrelation R(y(n),τ) of the frame y(n) of the noise-added signal Y(t) from the noise mixing unit 18. The normalized autocorrelation calculating unit 19 supplies the normalized autocorrelation R(y(n),τ) to the $R_{max}$ calculating unit 20.

In step S19, the $R_{max}$ calculating unit 20 obtains a lag range maximum correlation $R_{max}$(y(n) as a maximum value of the normalized autocorrelation R(y(n),τ) in a range of the lag τ corresponding to the fundamental frequency range, the normalized autocorrelation R(y(n),τ) being supplied from the normalized autocorrelation calculating unit 19. Then, in step S20, the $R_{max}$ calculating unit 20 outputs the lag range maximum correlating $R_{max}$(y(n)) as a feature quantity extracted from the frame x(n) of the input signal X(t).

Figure 5:
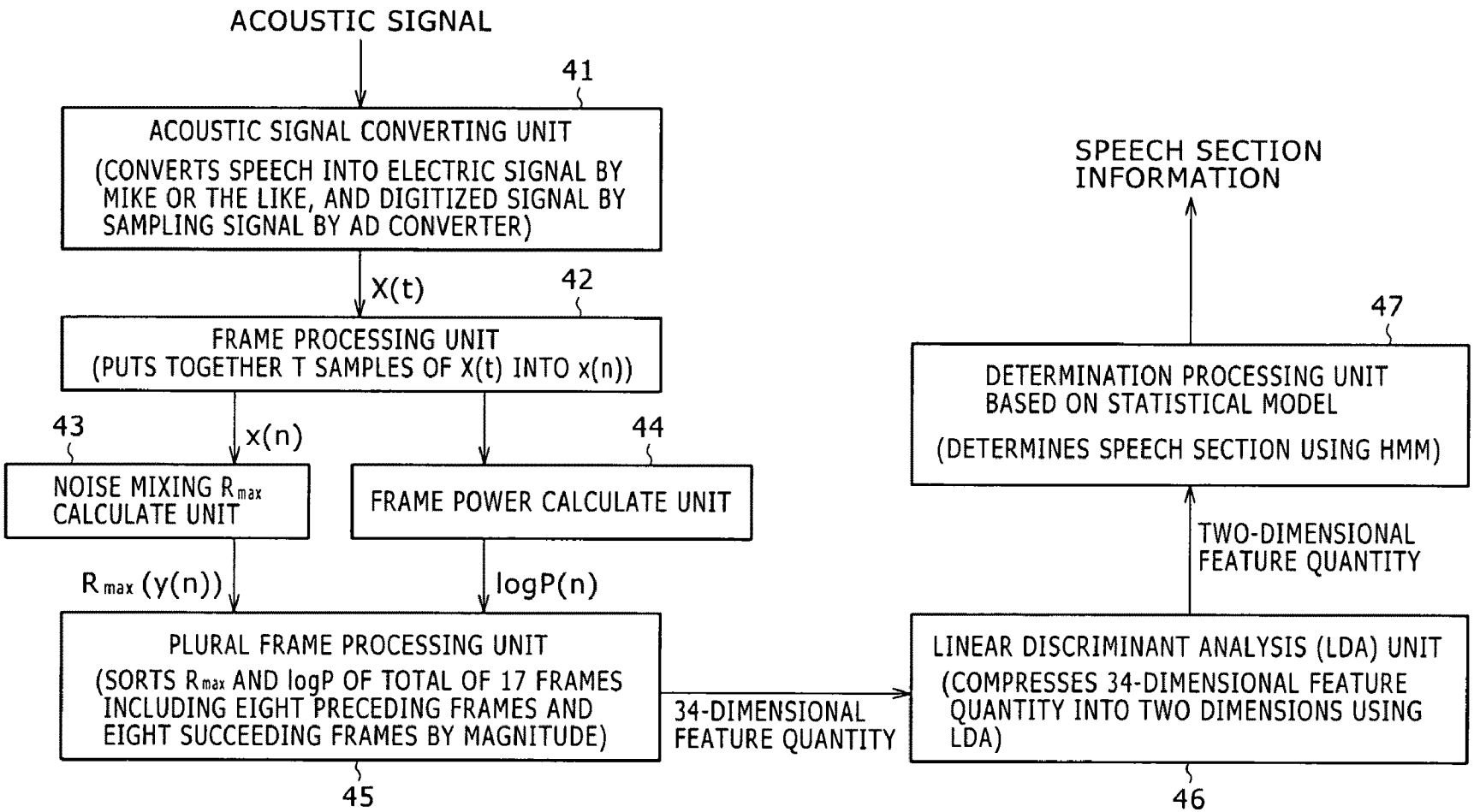
FIG. 5 is a block diagram showing an example of configuration of an embodiment of a speech section detecting device to which the present invention is applied.

FIG. 5 shows an example of configuration of an embodiment of a speech section detecting device to which the signal processing device of FIG. 3 is applied.

The speech section detecting device of FIG. 5 detects a speech section of an audio signal as an input signal X(t) using the lag range maximum correlation $R_{max}$(y(n)) of a noise-added signal Y(t) obtained by adding noise to the input signal X(t) as a feature quantity of the input signal X(t).

Specifically, in the speech section detecting device of FIG. 5, as with the acoustic signal converting unit 11 in FIG. 3, an acoustic signal converting unit 41 converts sound as air vibrations input thereto into an analog audio signal. The acoustic signal converting unit 41 further converts the analog audio signal into a digital audio signal. The acoustic signal converting unit 41 supplies the digital audio signal as an input signal X(t) to a frame processing unit 42.

As with the frame processing unit 12 in FIG. 3, the frame processing unit 42 performs frame processing that converts the input signal X(t) supplied from the acoustic signal converting unit 41 into a frame including sample values of T samples. A frame x(n) obtained as a result of the frame processing is supplied to a noise mixing Rmax calculating unit 43 and a frame power calculating unit 44.

The noise mixing Rmax calculating unit 43 is formed in the same manner as the noise mixing $R_{max}$ calculating unit in FIG. 3, that is, the normalized autocorrelation calculating unit 13, the $R_{max}$ calculating unit 14, the frame power calculating unit 15, the gain calculating unit 16, the Gaussian noise generating unit 17, the noise mixing unit 18, the normalized autocorrelation calculating unit 19, and the $R_{max}$ calculating unit 20. By performing a noise mixing Rmax calculating process, the noise mixing Rmax calculating unit 43 obtains the lag range maximum correlation $R_{max}$(y(n)) of a noise-added signal Y(t) from the frame x(n) supplied from the frame processing unit 42. The noise mixing $R_{max}$ calculating unit 43 supplies the lag range maximum correlation $R_{max}$(y(n)) to a plural frame processing unit 45.

Meanwhile, the frame power calculating unit 44 obtains the frame log power of the frame x(n) from the frame x(n) supplied from the frame processing unit 42. The frame power calculating unit 44 further obtains normalized log power logp (n) by normalizing the frame log power. The frame power calculating unit 44 supplies the normalized log power logp(n) to the plural frame processing unit 45.

Specifically, the frame power calculating unit 44 obtains the frame log power FP(n) by calculating a log of a sum total of respective squares of the T sample values of the frame x(n).

Further, the frame power calculating unit 44 obtains FPave (n) as an average value of the frame log power FP(n) by calculating an equation FPave(n)=ff×FPave(n−1)+(1−ff)×FP (n) using a forgetting factor ff, for example.

Then, the frame power calculating unit 44 subtracts the average value FPave(n) from the frame log power FP(n). The frame power calculating unit 44 supplies the subtraction value FP(n)−FPave(n) as the normalized log power logp(n) to the plural frame processing unit 45.

In this case, because the frame log power FP(n) is converted into the normalized log power logp(n) by subtracting the average value FPave(n) from the frame log power FP(n), an average of the normalized log power logp(n) is substantially zero. That is, the frame power calculating unit 44 normalizes the frame log power FP(n) to make the average of the normalized log power logp(n) zero.

The plural frame processing unit 45 combines (integrates) the lag range maximum correlation $R_{max}(y(n))$ from the noise mixing $R_{max}$ calculating unit 43 and the normalized log power logp(n) from the frame power calculating unit 44 to obtain a feature quantity (integrated feature quantity) of a frame of interest of the input signal X(t).

Specifically, supposing that an nth frame x(n) from a start of the input signal X(t) is referred to as the frame of interest, the plural frame processing unit 45 obtains a vector having, as components thereof, the lag range maximum correlations $R_{max}(y(n))$ and the normalized log powers logp(n) of the frame of interest and a certain number of frames preceding and succeeding the frame of interest at the feature quantity of the frame of interest.

Specifically, for example, the plural frame processing unit 45 sorts a total of 17 lag range maximum correlations $R_{max}(y(n))$, that is, the lag range maximum correlation $R_{max}(y(n))$ of the frame of interest and the respective lag range maximum correlations $R_{max}(y(n))$ of eight frames preceding the frame of interest and eight frames succeeding the frame of interest in ascending order, and sorts a total of 17 normalized log powers logp(n), that is, the normalized log power logp(n) of the frame of interest and the respective normalized log powers logp(n) of the eight frames preceding the frame of interest and the eight frames succeeding the frame of interest in ascending order. The plural frame processing unit 45 obtains a vector of 34 dimensions having, as components thereof, the 17 lag range maximum correlations $R_{max}(y(n))$ after being sorted and the 17 normalized log powers logp(n) after being sorted as the feature quantity of the frame of interest.

The plural frame processing unit 45 then supplies the vector of the 34 dimensions as the feature quantity of the frame of interest to a linear discriminant analysis unit 46.

The linear discriminant analysis unit 46 compresses the dimensions of the vector as the feature quantity of the frame x(n) from the plural frame processing unit 45. The linear discriminant analysis unit 46 then supplies the resulting vector to a determination processing unit 46.

Specifically, the linear discriminant analysis unit 46 compresses the vector of the 34 dimensions as the feature quantity of the frame x(n) from the plural frame processing unit 45 into a two-dimensional vector by linear discriminant analysis (LDA), for example. The linear discriminant analysis unit 46 then supplies the two-dimensional vector as the feature quantity of the frame x(n) to the determination processing unit 47.

The determination processing unit 47 determines whether the frame x(n) is a speech section frame or a non-speech section frame on the basis of the two-dimensional vector as the feature quantity from the linear discriminant analysis unit 46. The determination processing unit 47 outputs a result of the determination as speech section information.

Specifically, the determination processing unit 47 for example stores an HMM (Hidden Markov Model) learned for detection of a speech section. The determination processing unit 47 determines whether the frame x(n) is a speech section frame or a non-speech section frame on the basis of likelihood of the feature quantity from the linear discriminant analysis unit 46 being observed in the HMM. The determination processing unit 47 outputs a result of the determination as speech section information.

Incidentally, Non-Patent Document 2 describes a method of using the lag range maximum correlation $R_{max}(x(n))$ and normalized log power logp(n) of the input signal X(t) as feature quantity in place of the lag range maximum correlation $R_{max}(y(n))$ of the noise-added signal Y(t) obtained by adding noise to the input signal X(t), and detecting a speech section using a tied-state HMM with five states. The tied-state HMM in this case means that a speech HMM and a non-speech HMM each have five states and that the five states of each of the speech HMM and the non-speech HMM share (tied) a same mixed Gaussian distribution (GMM: Gaussian Mixture Model).

The speech section detection performed in the speech section detecting device of FIG. 5 differs from the method described in Non-Patent Document 2 in that the speech section detection performed in the speech section detecting device of FIG. 5 uses the lag range maximum correlation $R_{max}(y(n)$ of the noise-added signal Y(t) obtained by adding noise to the input signal X(t) as feature quantity in place of the lag range maximum correlation $R_{max}(x(n))$ of the input signal X(t) and in that the speech section detection performed in the speech section detecting device of FIG. 5 uses a normal five-state HMM that is not a tied-state HMM for identification of a speech section in place of the tied-state HMM with five states.

Results of an experiment in detection of speech sections which experiment was conducted with the speech section detecting device of FIG. 5 will next be described with reference to FIGS. 6 to 14.

In the experiment, an analog audio signal obtained by a mike used in a QRIO(R), which is a bipedal walking robot developed by Sony Corporation, was converted into a digital audio signal by being sampled at a sampling frequency of 16 kHz, and the digital audio signal was used as an input signal X(t).

Further, in the experiment, the length T (number of samples) of a frame was set to 1024 samples, and a frame x(n) was extracted from the input signal X(t) while making a shift by 160 samples.

In addition, in the experiment, 0.99 was employed as the forgetting factor if in obtaining the average value FPave(n) used for obtaining the normalized log power logp(n) according to the equation $FPave(n)=ff\times FPave(n-1)+(1-ff)\times FP(n)$.

Further, a mixed Gaussian distribution was used as probability density function of the HMM used to identify a speech section. In addition, an HMM for speech sections and an HMM for non-speech sections were prepared, and an input signal X(t) for learning the HMMs was prepared. A two-dimensional vector similar to that obtained by the linear discriminant analysis unit 46 was obtained as a feature quantity from the input signal X(t) for learning. A feature quantity obtained from a speech section of the input signal X(t) for learning was given to the HMM for speech sections, and a feature quantity obtained from a non-speech section of the input signal X(t) for learning was given to the HMM for non-speech sections, whereby the HMM for speech sections and the HMM for non-speech sections were learned.

In the experiment, a human labeled frames at a start and an end of a speech section of an input signal X(t) for the experiment, and a speech section indicated by speech section information output by the determination processing unit 47 and the speech section having the frames at the start and the end thereof labeled by the human were compared with each other to determine whether the speech section indicated by the speech section information output by the determination processing unit 47 was correct or not.

Specifically, supposing that the frames at the start and the end of the speech section labeled by the human are a Tsth frame and a Teth frame, respectively, and that frames at a start and an end of the speech section indicated by the speech section information output by the determination processing unit 47 are an Ssth frame and an Seth frame, respectively, it was determined that the speech section indicated by the speech section information output by the determination processing unit 47 was correct when Ss satisfied an equation Te<=Se<=Te+40.

Incidentally, in addition, used in the experiment as the function $F(p(n),R_{max}(x(n)))$ for obtaining the gain gain(n) were not only the function for obtaining a minimum value of products $p(n)\times R_{max}(x(n))$ of the frame powers p(n) and the lag range maximum correlations $R_{max}(x(n))$ of N consecutive frames, respectively, including the frame x(n) (the function will hereinafter be referred to as a product minimum value function as appropriate but also a function for obtaining an average value of the products $p(n)\times R_{max}(x(n))$ of the frame powers p(n) and the lag range maximum correlations $R_{max}(x(n))$ of the N consecutive frames, respectively, including the frame x(n) (the function will hereinafter be referred to as a product average value function as appropriate) and a function for obtaining a minimum value of frame powers p(n) of the N consecutive frames, respectively, including the frame x(n) (the function will hereinafter be referred to as a power minimum value function as appropriate).

In addition, 40 frames were used as the N frames for defining the function $F(p(n),R_{max}(x(n)))$.

Figure 6:
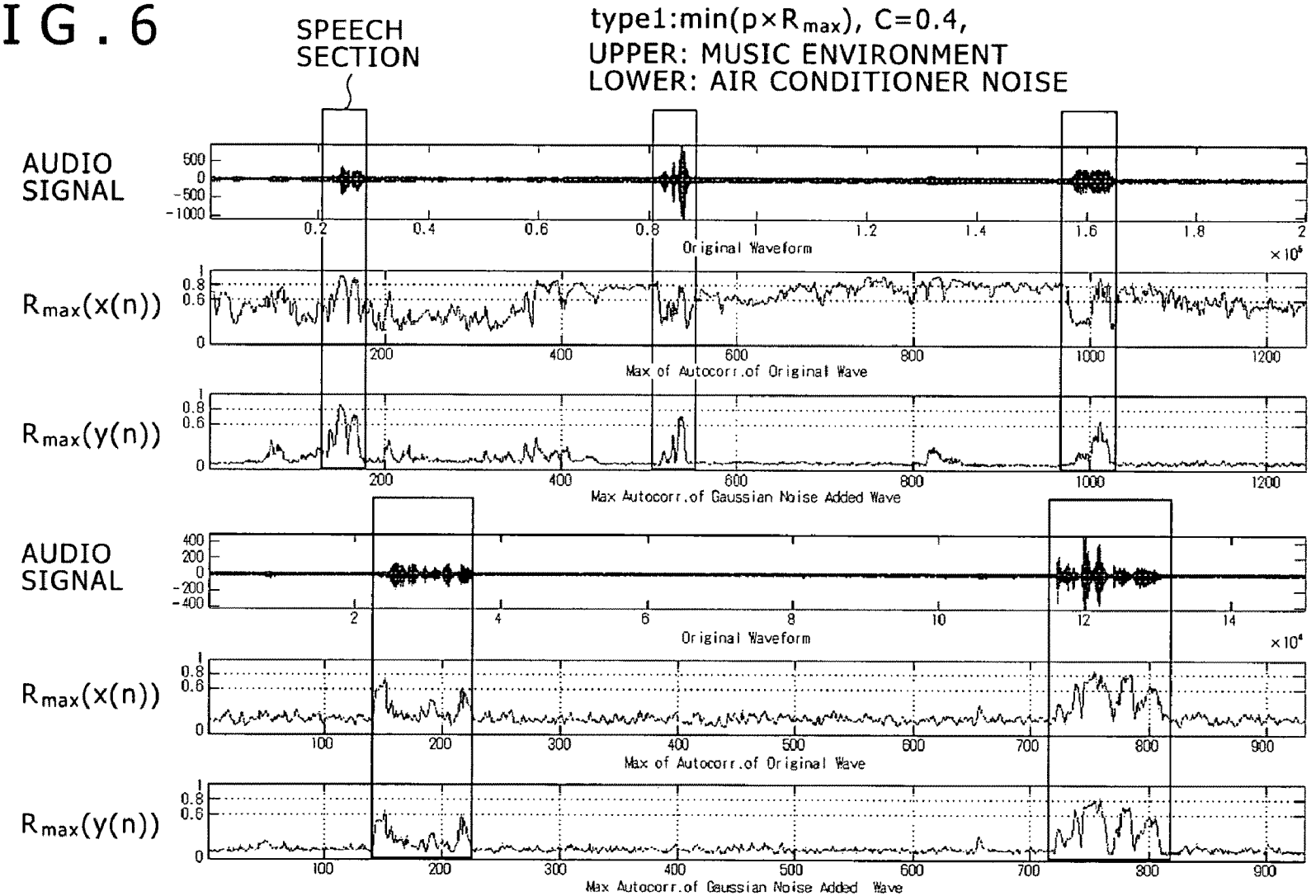
FIG. 6 is a waveform chart showing the lag range maximum correlation $R_{max}(x(n))$ of a noise-added signal Y(t)

FIG. 6 shows the lag range maximum correlation $R_{max}(y(n))$ of the noise-added signal Y(t) when the product minimum value function was used as the function $F(p(n),R_{max}(x(n)))$ in the experiment.

Specifically, an upper half side of FIG. 6 shows the lag range maximum correlation $R_{max}(y(n))$ of the noise-added signal Y(t) obtained with an audio signal obtained by collecting sound in an environment where music flowed (music environment) as an input signal X(t). A lower half side of FIG. 6 shows the lag range maximum correlation $R_{max}(y(n))$ of the noise-added signal Y(t) obtained with an audio signal obtained by collecting sound in an environment where an air conditioner was operating (air conditioner environment) as an input signal X(t).

A first row from the top of the upper half side of FIG. 6 shows the audio signal obtained by collecting sound in the music environment, that is, the input signal X(t). A second row from the top of the upper half side of FIG. 6 shows the lag range maximum correlation $R_{max}(x(n))$ of the input signal X(t). A third row from the top of the upper half side of FIG. 6 shows the lag range maximum correlation $R_{max}(y(n))$ of the noise-added signal Y(t) obtained by adding noise to the input signal X(t).

A first row from the top of the lower half side of FIG. 6 shows the audio signal obtained by collecting sound in the air conditioner environment, that is, the input signal X(t). A second row from the top of the lower half side of FIG. 6 shows the lag range maximum correlation $R_{max}(x(n))$ of the input signal X(t) in the first row. A third row from the top of the lower half side of FIG. 6 shows the lag range maximum correlation $R_{max}(y(n))$ of the noise-added signal Y(t) obtained by adding noise to the input signal X(t) in the first row.

Incidentally, a part enclosed by a vertically long rectangle in FIG. 6 represents a speech section. The same is true for FIG. 7 to be described later.

Figure 7:
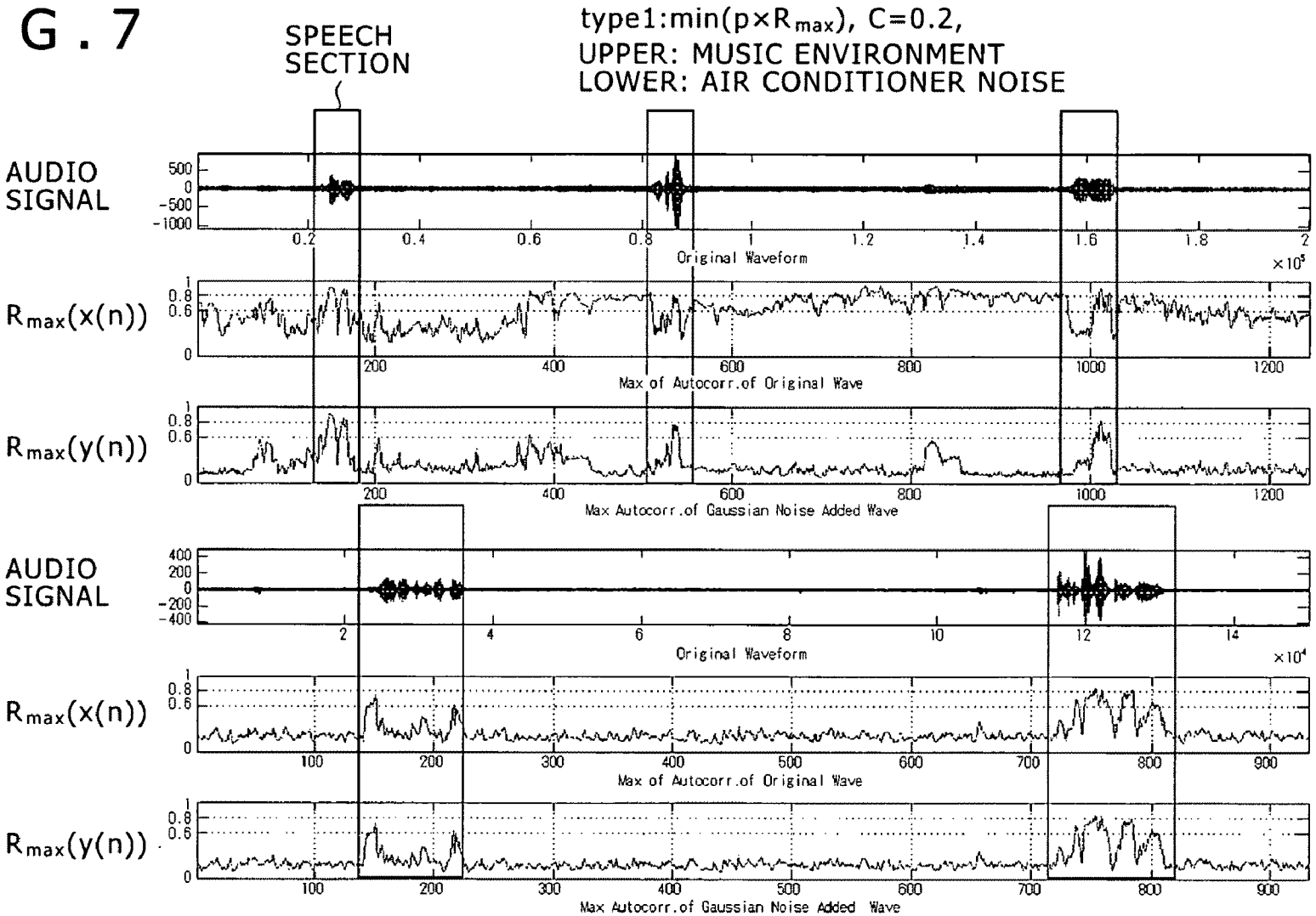
FIG. 7 is a waveform chart showing the lag range maximum correlation $R_{max}(y(n))$ of a noise-added signal Y(t)

As with FIG. 6, FIG. 7 shows the lag range maximum correlation $R_{max}(y(n))$ of the noise-added signal Y(t) when the product minimum value function was used as the function $F(p(n),R_{max}(x(n))$ in the experiment.

However, while in FIG. 6, 0.4 is adopted as the constant C for defining the equation $y(n)=x(n)+C\times gain(n)\times g$ used to obtain the noise-added signal Y(t), 0.2 is adopted as the constant C in FIG. 7. Other conditions of FIG. 7 are the same as in FIG. 6.

A comparison of the lag range maximum correlation $R_{max}(x(n))$ of the input signal X(t) with the lag range maximum correlation $R_{max}(y(n))$ of the noise-added signal Y(t) is FIG. 6 and FIG. 7 indicates that the lag range maximum correlation $R_{max}(y(n))$ of the noise-added signal Y(t) retains the value of the lag range maximum correlation $R_{max}(x(n))$ of the input signal X(t) in speech sections and has values lower than the lag range maximum correlation $R_{max}(x(n))$ of the input signal X(t) as non-speech sections.

It is thus understood that the gain calculating unit 16 in FIG. 3 adjusts the level of the noise added to the input signal X(t) properly, and that as a result, the noise mixing unit 18 adds noise of a high level to a part of the input signal X(t) in which part speech is not present and adds noise of a low level to a part of the input signal X(t) in which part speech is present.

Figure 8:
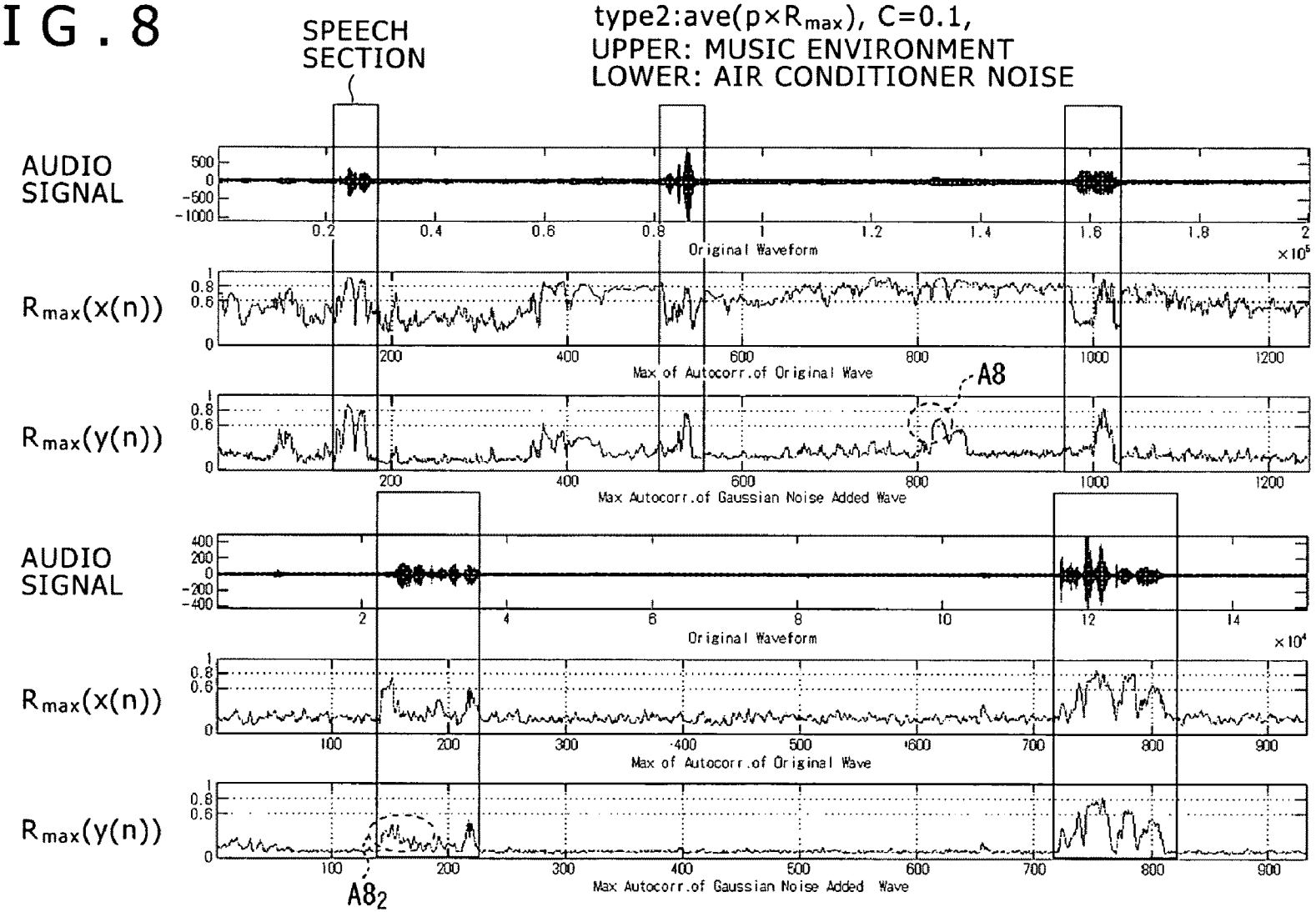
FIG. 8 is a waveform chart showing the lag range maximum correlation $R_{max}(y(n))$ of a noise-added signal Y(t)

FIG. 8 shows the lag range maximum correlation $R_{max}(y(n))$ of the noise-added signal Y(t) when the product average value function was used as the function $F(p(n),R_{max}(x(n)))$ in the experiment.

Specifically, as with the upper half side of FIG. 6 described above, an upper half side of FIG. 8 shows the lag range maximum correlation $R_{max}(y(n))$ of the noise-added signal Y(t) obtained with an audio signal obtained by collecting sound in the music environment as an input signal X(t). As with the lower half side of FIG. 6 described above, a lower half side of FIG. 8 shows the lag range maximum correlation $R_{max}(y(n))$ of the noise-added signal Y(t) obtained with an audio signal obtained by collecting sound in the air conditioner environment as an input signal X(t).

However, in FIG. 8, as described above, the product average value function rather than the product minimum value function is used as the function $F(p(n),R_{max}(x(n)))$.

A first row from the top of the upper half side of FIG. 8 shows the audio signal obtained by collecting sound in the music environment, that is, the input signal X(t). A second row from the top of the upper half side of FIG. 8 shows the lag range maximum correlation $R_{max}(x(n))$ of the input signal X(t). A third row from the top of the upper half side of FIG. 8 shows the lag range maximum correlation $R_{max}(y(n))$ of the noise-added signal Y(t) obtained by adding noise to the input signal X(t).

A first row from the top of the lower half side of FIG. 8 shows the audio signal obtained by collecting sound in the air conditioner environment, that is, the input signal X(t). A second row from the top of the lower half side of FIG. 8 shows the lag range maximum correlation $R_{max}(x(n))$ of the input signal X(t) in the first row. A third row from the top of the lower half side of FIG. 8 shows the lag range maximum correlation $R_{max}(y(n))$ of the noise-added signal Y(t) obtained by adding noise to the input signal X(t) in the first row.

Incidentally, a part enclosed by a vertically long rectangle in FIG. 8 represents a speech section. The same is true for FIG. 9 to be described later.

Figure 9:
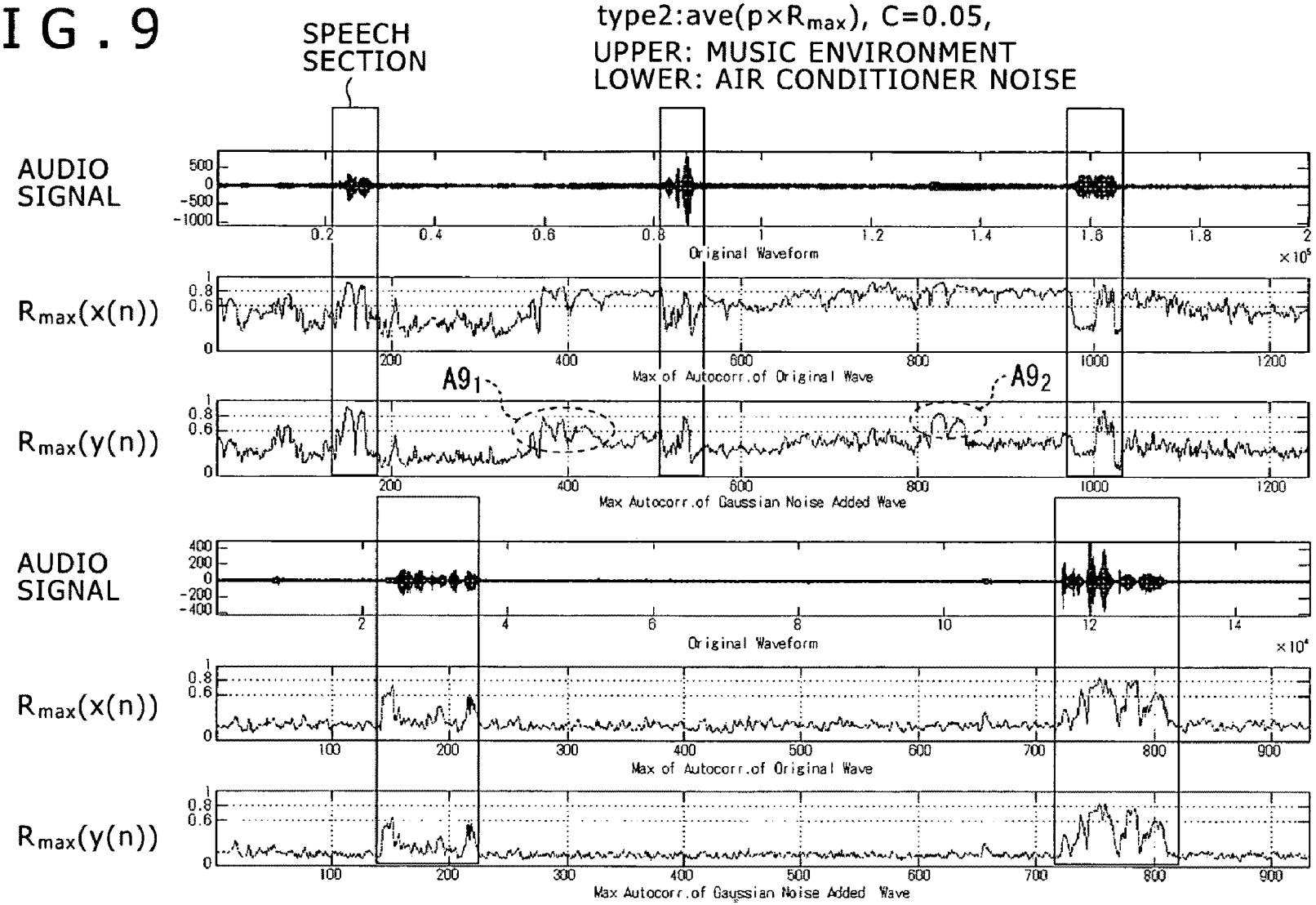
FIG. 9 is a waveform chart showing the lag range maximum correlation $R_{max}(y(n))$ of a noise-added signal Y(t)

As with FIG. 8, FIG. 9 shows the lag range maximum correlation $R_{max}(y(n))$ of the noise-added signal Y(t) when the product average value function was used as the function $F(p(n),R_{max}(x(n)))$ in the experiment.

However, while in FIG. 8, 0.1 is adopted as the constant C for defining the equation $y(n)=x(n)+C\times gain(n)\times g$ used to obtain the noise-added signal Y(t), 0.05 is adopted as the constant C in FIG. 9. Other conditions of FIG. 9 are the same as in FIG. 8.

The lag range maximum correlation $R_{max}(y(n))$ of the noise-added signal Y(t) in a part indicated by A8$_1$ in FIG. 8 has values on a same level as in speech sections even though the lag range maximum correlation $R_{max}(y(n))$ of the noise-added signal Y(t) is in a non-speech section. This indicates that noise of sufficient magnitude is not added to the input signal X(t).

The lag range maximum correlation $R_{max}(y(n))$ of the noise-added signal Y(t) in a part indicated by A8$_2$ in FIG. 8 has values lower than the lag range maximum correlation $R_{max}(x(n))$ of the input signal X(t) even though the lag range maximum correlation $R_{max}(y(n))$ of the noise-added signal Y(t) is in a speech section. This indicates that the level of noise added to the input signal X(t) is too high.

When the constant C is increased, the value of the lag range maximum correlation $R_{max}(y(n))$ of the noise-added signal Y(t) in the non-speech section, or the values in the part indicated by A8$_1$ in FIG. 8, for example, can be decreased. However, when the constant C is increased, the value of the lag range maximum correlation $R_{max}(y(n))$ of the noise-added signal Y(t) in the speech section, or the values in the part indicated by A8$_2$ in FIG. 8, for example, are further decreased.

On the other hand, by decreasing the constant C, the value of the lag range maximum correlation $R_{max}(y(n))$ of the noise-added signal Y(t) in the speech section, or the values in the part indicated by A8$_2$ in FIG. 8, for example, can be increased to be on the same level as the value of the lag range maximum correlation $R_{max}(x(n))$ of the input signal X(t).

However, a comparison between FIG. 8 where the constant C is 0.1 and FIG. 9 where the constant C is 0.05, which is lower than 0.1, indicates that when the constant C is decreased, the value of the lag range maximum correlation $R_{max}(y(n))$ of the noise-added signal Y(t) in non-speech sections may not be decreased.

Specifically, when the constant C is decreased, as indicated by A9$_1$ and A9$_2$ in FIG. 9, the lag range maximum correlation $R_{max}(y(n))$ of the noise-added signal Y(t) in non-speech sections has high values on the same level as in speech sections.

Figure 10:
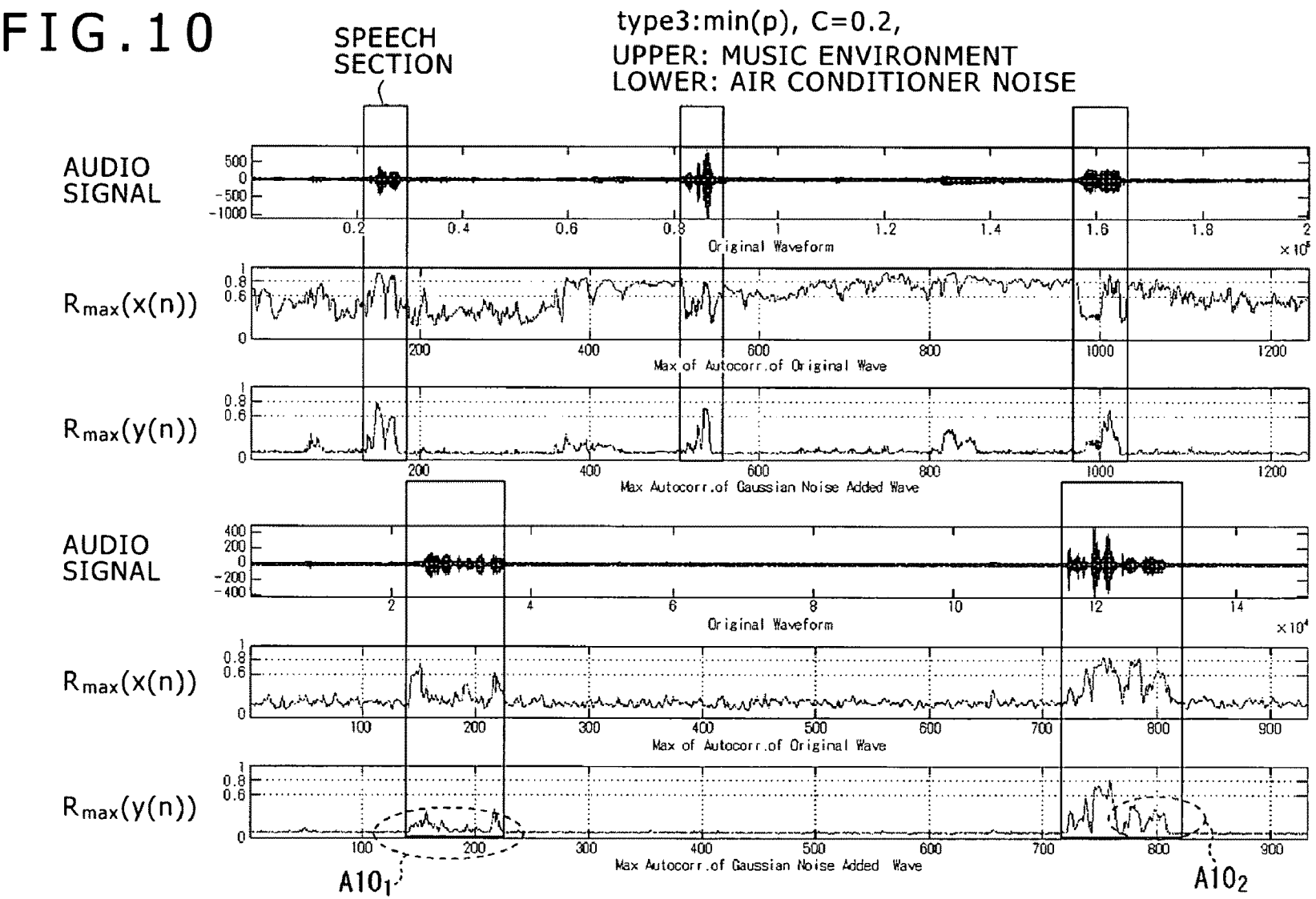
FIG. 10 is a waveform chart showing the lag range maximum correlation $R_{max}(y(n))$ of a noise-added signal Y(t)

FIG. 10 shows the lag range maximum correlation $R_{max}(y(n))$ of the noise-added signal Y(t) when the power minimum value function was used as the function $F(p(n),R_{max}(x(n)))$ in the experiment.

Specifically, as with the upper half side of FIG. 6 described above, an upper half side of FIG. 10 shows the lag range maximum correlation $R_{max}(y(n))$ of the noise-added signal Y(t) obtained with an audio signal obtained by collecting sound in the music environment as an input signal X(t). As with the lower half side of FIG. 6 described above, a lower half side of FIG. 10 shows the lag range maximum correlation $R_{max}(y(n))$ of the noise-added signal Y(t) obtained with an audio signal obtained by collecting sound in the air conditioner environment as an input signal X(t).

However, in FIG. 10, as described above, the power minimum value function rather than the product minimum value function is used as the function $F(p(n),R_{max}(x(n)))$.

A first row from the top of the upper half side of FIG. 10 shows the audio signal obtained by collecting sound in the music environment, that is, the input signal X(t). A second row from the top of the upper half side of FIG. 10 shows the lag range maximum correlation $R_{max}(x(n))$ of the input signal X(t) in the first row. A third row from the top of the upper half side of FIG. 10 shows the lag range maximum correlation $R_{max}(y(n))$ of the noise-added signal Y(t) obtained by adding noise to the input signal X(t) in the first row.

A first row from the top of the lower half side of FIG. 10 shows the audio signal obtained by collecting sound in the air conditioner environment, that is, the input signal X(t). A second row from the top of the lower half side of FIG. 10 shows the lag range maximum correlation $R_{max}(x(n))$ of the input signal X(t) in the first row. A third row from the top of the lower half side of FIG. 10 shows the lag range maximum correlation $R_{max}(y(n))$ of the noise-added signal Y(t) obtained by adding noise to the input signal X(t) in the first row.

Incidentally, a part enclosed by a vertically long rectangle in FIG. 10 represents a speech section. The same is true for FIG. 11 and FIG. 12 to be described later.

Figure 11:
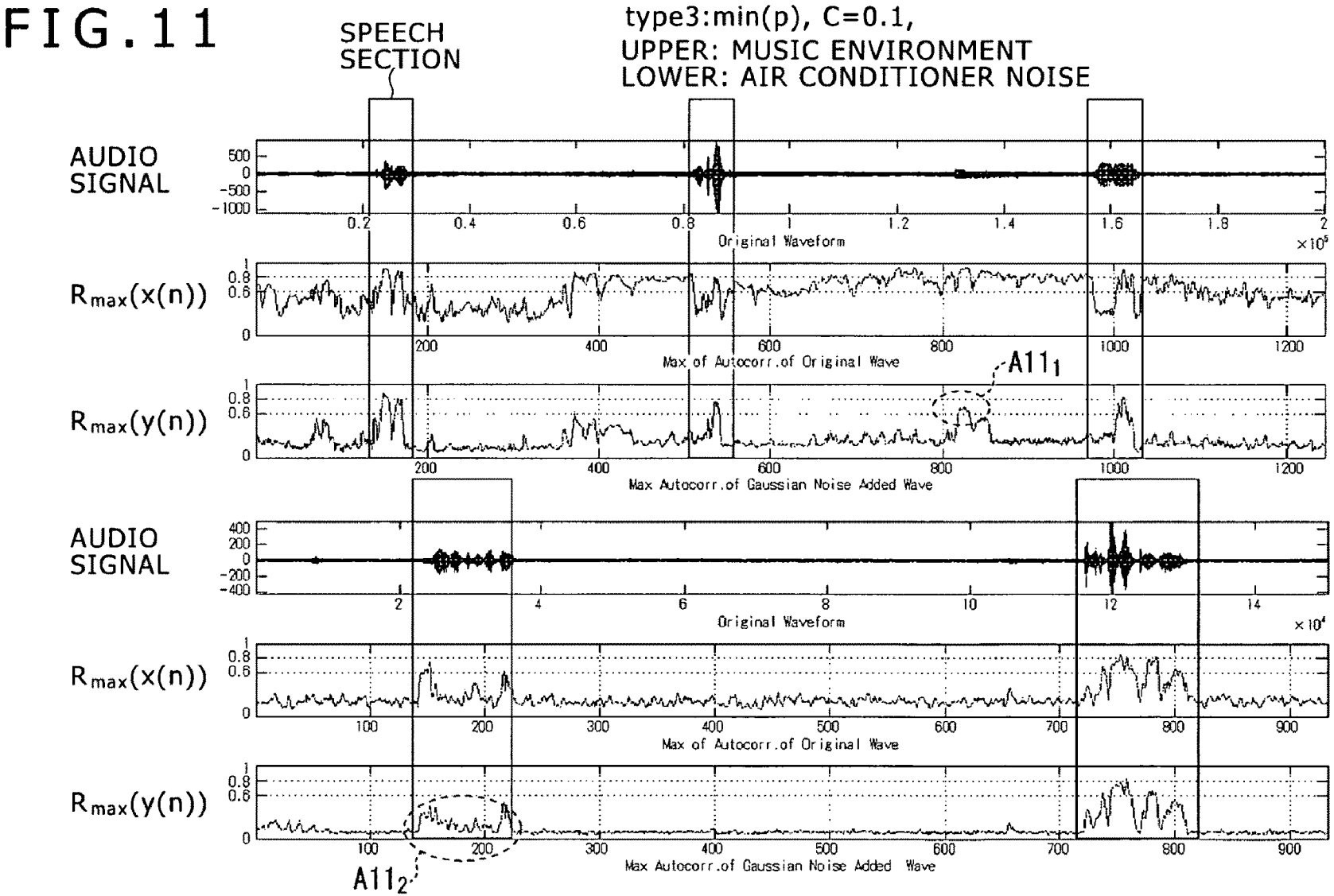
FIG. 11 is a waveform chart showing the lag range maximum correlation $R_{max}(y(n))$ of a noise-added signal Y(t)
Figure 12:
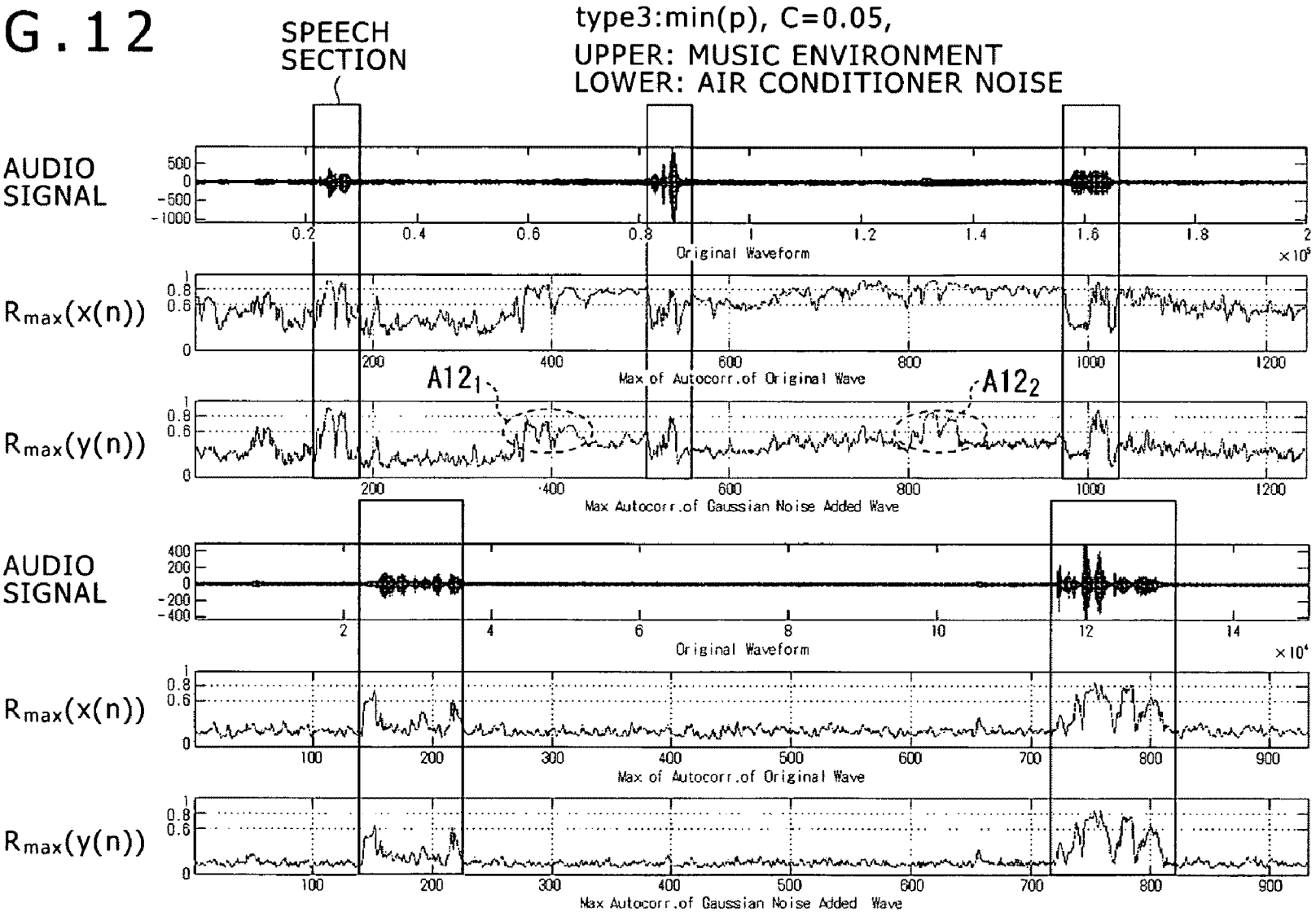
FIG. 12 is a waveform chart showing the lag range maximum correlation $R_{max}(y(n))$ of a noise-added signal Y(t)

As with FIG. 10, FIG. 11 and FIG. 12 show the lag range maximum correlation $R_{max}(y(n))$ of the noise-added signal Y(t) when the power minimum value function was used as the function $F(p(n),R_{max}(x(n)))$ in the experiment.

However, while in FIG. 10, 0.2 is adopted as the constant C for defining the equation $y(n)=x(n)+C\times gain(n)\times g$ used to obtain the noise-added signal Y(t), 0.1 is adopted as the constant C in FIG. 11, and 0.05 is adopted as the constant C in FIG. 12.

In regard to the magnitude of the constant C, FIGS. 10 to 12 in which the power minimum value function is used as the function $F(p(n),R_{max}(x(n)))$ have basically the same tendencies as FIG. 8 and FIG. 9 in which the product average value function is used as the function $F(p(n),R_{max}(x(n)))$.

For example, the lag range maximum correlation $R_{max}(y(n))$ of the noise-added signal Y(t) in parts indicated by A10$_1$ and A10$_2$ in FIG. 10 with a constant C of 0.2 has values lower than the lag range maximum correlation $R_{max}(x(n))$ of the input signal X(t) even though the lag range maximum correlation $R_{max}(y(n))$ of the noise-added signal Y(t) is in speech sections. This indicates that the level of noise added to the input signal X(t) in the parts indicated by A10$_1$ and A10$_2$ is too high.

The lag range maximum correlation $R_{max}(y(n))$ of the noise-added signal Y(t) in a part indicated by A11$_1$ in FIG. 11 with a constant C of 0.1 has values on a same level as in speech sections even though the lag range maximum correlation $R_{max}(y(n))$ of the noise-added signal Y(t) is in a non-speech section. This indicates that noise of sufficient magnitude is not added to the input signal X(t) in the part indicated by A11$_1$.

The lag range maximum correlation $R_{max}(y(n))$ of the noise-added signal Y(t) in a part indicated by A11$_2$ in FIG. 11 has values lower than the lag range maximum correlation $R_{max}(x(n))$ of the input signal X(t) even though the lag range maximum correlation $R_{max}(y(n))$ of the noise-added signal Y(t) is in a speech section. This indicates that the level of noise added to the input signal X(t) in the part indicated by A11$_2$ is too high.

The lag range maximum correlation $R_{max}(y(n))$ of the noise-added signal Y(t) in parts indicated by A12$_1$ and A12$_2$ in FIG. 12 with a constant C of 0.05 has values on a same level as in speech sections even though the lag range maximum correlation $R_{max}(y(n))$ of the noise-added signal Y(t) is in non-speech sections. This indicates that noise of sufficient magnitude is not added to the input signal X(t) in the parts indicated by A12$_1$ and A12$_2$.

FIG. 13 and FIG. 14 show rates of correct detection of speech sections obtained in the experiment using the speech section detecting device of FIG. 5.

In the experience, speech sections were detected while changing the constant C with each of an audio signal obtained by collecting sound in the music environment, an audio signal obtained by collecting sound in the air conditioner environment, and an audio signal obtained by collecting sound in an environment in which a QRIO(R), which is a bipedal walking robot developed by Sony Corporation, was operating (robot environment) as input signal X(t).

FIG. 13 shows correct detection rates when adopting the constant C resulting in high correct detection rates in the case where speech sections were detected with an audio signal obtained by collecting sound in the music environment as input signal X(t). FIG. 14 shows correct detection rates when adopting the constant C resulting in high correct detection rates in the case where speech sections were detected with each of an audio signal obtained by collecting sound in the air conditioner environment and an audio signal obtained by collecting sound in the robot environment as input signal X(t).

First rows in FIG. 13 and FIG. 14 show correct detection rates for the respective audio signals obtained by collecting sound in the music environment, the air conditioner environment, and the robot environment in a case where a set of the lag range maximum correlation $R_{max}(x(n))$ and the normalized log power logp(n) of the input signal X(t) is used as a feature quantity without using the lag range maximum correlation $R_{max}(y(n))$ of the noise-added signal Y(t) obtained by adding noise to the input signal X(t), and the feature quantity is given to the determination processing unit 47 via the linear discriminant analysis unit 46 in FIG. 5 (this case will hereinafter be referred to as a baseline case as appropriate).

Second to fourth rows in FIG. 13 and FIG. 14 show correct detection rates for the respective audio signals obtained by collecting sound in the music environment, the air conditioner environment, and the robot environment in a case where a set of the lag range maximum correction $R_{max}(y(n))$ of the noise-added signal Y(t) obtained by adding noise to the input signal X(t) and the normalized log power logp(n) of the input signal X(t) is used as a feature quantity, and the feature quantity is given to the determination processing unit 47 via the linear discriminant analysis unit 46 in FIG. 5 (this case will hereinafter be referred to as a case of a noise level adjusting system as appropriate).

In the second rows of the second to fourth rows in FIG. 12 and FIG. 14, the product minimum value function is adopted as the function $F(p(n),R_{max}(x(n)))$. In the third row, the product average value function is adopted as the function $F(p(n),R_{max}(x(n)))$. In the fourth rows of the second to fourth rows in FIG. 13 and FIG. 14, the power minimum value function is adopted as the function $F(p(n),R_{max}(x(n)))$.

Incidentally, in FIG. 13 in which the constant C is adjusted so as to raise correct detection rates for the audio signal obtained by collecting sound in the music environment, the constant C when the function $F(p(n),R_{max}(x(n)))$ is the product minimum value function in the second row of FIG. 13 is 0.4.

The constant C when the function $F(p(n),R_{max}(x(n)))$ is the product average value function in the third row of FIG. 13 is 0.1. The constant C when the function $F(p(n),R_{max}(x(n)))$ is the power minimum value function in the fourth row of FIG. 13 is 0.2.

In FIG. 14 in which the constant C is adjusted so as to raise correct detection rates for the audio signals obtained by collecting sound in the air conditioner environment and the robot environment, the constant C when the function $F(p(n),R_{max}(x(n)))$ is the product minimum value function in the second row of FIG. 14 is 0.2.

The constant C when the function $F(p(n),R_{max}(x(n)))$ is the product average value function in the third row of FIG. 14 is 0.025. The constant C when the function $F(p(n),R_{max}(x(n)))$ is the power minimum value function in the fourth row of FIG. 14 is 0.05.

Of the music environment, the air conditioner environment, and the robot environment, the music environment in particular has noise (music) with a high degree of periodicity.

Thus, in the baseline case, the lag range maximum correction $R_{max}(x(n))$ of the input signal X(t) has high values not only in speech sections but also in non-speech sections. As a result, as shown in the first rows of FIG. 13 and FIG. 14, the correct detection rate for the audio signal obtained by collecting sound in the music environment is considerably lower than the correct detection rates for the audio signals obtained by collecting sound in the other environments, that is, the air conditioner environment and the robot environment.

Specifically, in the baseline case, as shown in the first rows of FIG. 13 and FIG. 14, the correct detection rate for the audio signal obtained by collecting sound in the robot environment is 94.63, and the correct detection rate for the audio signal obtained by collecting sound in the air conditioner environment is 93.12, the correct detection rates being high correct detection rates, whereas the correct detection rate for the audio signal obtained by collecting sound in the music environment is 8.75, which is significantly low.

In the case of the noise level adjusting system in FIG. 13 in which the constant C is adjusted so as to raise correct detection rates for the audio signal obtained by collecting sound in the music environment, as shown in the second to fourth rows of FIG. 13, the correct detection rate for the audio signal obtained by collecting sound in the music environment when the product minimum value function, the product average value function, or the power minimum value function is adopted as the function $F(p(n),R_{max}(x(n)))$ is 45.00, 46.25, or 45.00, respectively, when values each represent a dramatic improvement over the correct detection rate of 8.75 in the baseline case.

In the case of the noise level adjusting system in the second to fourth rows of FIG. 13, the correct detection rate for the audio signal obtained by collecting sound in the robot environment when the product minimum value function is adopted as the function $F(p(n),R_{max}(x(n)))$ is 94.12, as shown in the second row of FIG. 13, which value is on the same level as the correct detection rate (94.63) for the audio signal obtained by collecting sound in the robot environment in the baseline case.

In the case of the noise level adjusting system in FIG. 13, the correct detection rate for the audio signal obtained by collecting sound in the air conditioner environment when the product minimum value function is adopted as the function $F(p(n),R_{max}(x(n)))$ is 96.25, as shown in the second row of FIG. 13, which value is improved as compared with the correct detection rate (93.12) for the audio signal obtained by collecting sound in the air conditioner environment in the baseline case.

However, in the case of the noise level adjusting system in FIG. 13, the correct detection rate for the audio signal obtained by collecting sound in the robot environment when the product average value function or the power minimum value function is adopted as the function $F(p(n),R_{max}(x(n)))$ is respectively 84.94 or 89.80, as shown in the third row or the fourth row of FIG. 13, which values are somewhat lowered as compared with the correct detection rate (94.12) shown in the second row when the product minimum value function is adopted as the function $F(p(n),R_{max}(x(n)))$.

In the case of the noise level adjusting system in FIG. 13, the correct detection rate for the audio signal obtained by collecting sound in the air conditioner environment when the product average value function or the power minimum value function is adopted as the function $F(p(n),R_{max}(x(n)))$ is respectively 88.12 or 93.12, as shown in the third row or the fourth row of FIG. 13, which values are somewhat lowered as compared with the correct detection rate (96.25) shown in the second row when the product minimum value function is adopted as the function $F(p(n),R_{max}(x(n)))$.

In the case of the noise level adjusting system in FIG. 14 in which the constant C is adjusted so as to raise correct detection rates for the audio signals obtained by collecting sound in the robot environment and the air conditioner environment, as shown in the second to fourth rows of FIG. 14, the correct detection rate for the audio signal obtained by collecting sound in the music environment when the product minimum value function, the product average value function, or the power minimum value function is adopted as the function $F(p(n),R_{max}(x(n)))$ is 42.50, 17.50, or 13.75, respectively, which values each represent an improvement over the correct detection rate of 8.75 in the baseline case.

However, in the case of the noise level adjusting system in FIG. 14, the correct detection rate for the audio signal obtained by collecting sound in the music environment when the product minimum value function is adopted as the function $F(p(n),R_{max}(x(n)))$ is 42.50, which value represents a significant improvement over the correct detection rate (17.50) when the product average value function is adopted as the function $F(p(n),R_{max}(x(n)))$ or the correct detection rate (13.75) when the power minimum value function is adopted as the function $F(p(n),R_{max}(x(n)))$.

In the case of the noise level adjusting system in the second to fourth rows of FIG. 14, the correct detection rate for the audio signal obtained by collecting sound in the robot environment when the product minimum value function is adopted as the function $F(p(n),R_{max}(x(n)))$ is 94.78, as shown in the second row of FIG. 14, which value is on the same level as the correct detection rate (94.63) for the audio signal obtained by collecting sound in the robot environment in the baseline case.

In the case of the noise level adjusting system in FIG. 14, the correct detection rate for the audio signal obtained by collecting sound in the air conditioner environment when the product minimum value function is adopted as the function $F(p(n),R_{max}(x(n)))$ is 96.25, as shown in the second row of FIG. 14, which value is improved as compared with the correct detection rate (93.12) for the audio signal obtained by collecting sound in the air conditioner environment in the baseline case.

In the case of the noise level adjusting system in FIG. 14, the correct detection rate for the audio signal obtained by collecting sound in the robot environment when the product average value function or the power minimum value function is adopted as the function $F(p(n),R_{max}(x(n)))$ is respectively 94.84 or 93.98, as shown in the third row or the fourth row of FIG. 14, which values are on the same level as the correct detection rate (94.78) shown in the second row when the product minimum value function is adopted as the function $F(p(n),R_{max}(x(n)))$.

In the case of the noise level adjusting system in FIG. 14, the correct detection rate for the audio signal obtained by collecting sound in the air conditioner environment when the product average value function or the power minimum value function is adopted as the function $F(p(n),R_{max}(x(n)))$ is respectively 93.12 or 96.25, as shown in the third row or the fourth row of FIG. 14, which values are on the same level as the correct detection rate (96.25) shown in the second row when the product minimum value function is adopted as the function $F(p(n),R_{max}(x(n)))$.

As described above, in the case of the noise level adjusting system, when the product average value function or the power minimum value function is adopted as the function $F(p(n),R_{max}(x(n)))$, and the constant C is fixed to a value suitable for a specific environment such for example as the music environment, the correct detection rate for the audio signal obtained by collecting sound in the specific environment (for example the music environment) is raised, but the correct detection rate for the audio signals obtained by collecting sound in other environments such for example as the robot environment and the air conditioner environment is lowered. Hence, when the product average value function or the power minimum value function is adopted as the function $F(p(n),R_{max}(x(n)))$, the correct detection rate is relatively varied depending on a type of noise included in an audio signal as input signal X(t), and it can thus be said that noise robustness is low.

On the other hand, in the case of the noise level adjusting system, when the product minimum value function is adopted as the function $F(p(n),R_{max}(x(n)))$, even when the constant C is fixed to a value suitable for a specific environment, the correct detection rate for the audio signal obtained by collecting sound in any of the music environment, the robot environment, and the air conditioner environment can be maintained at a high value. Hence, when the product minimum value function is adopted as the function $F(p(n),R_{max}(x(n)))$, a high correct detection rate can be obtained irrespective of a type of noise included in an audio signal as input signal X(t).

The product minimum value function obtains a minimum value of products $p(n)\times R_{max}(x(n))$ of the frame powers p(n) and the lag range maximum correlations $R_{max}(x(n))$ of N respective consecutive frames. The product average value function obtains an average value of the products $p(n)\times R_{max}(x(n))$ of the N respective consecutive frames. Thus, it can be said that the use of the minimum value of the products $p(n)\times R_{max}(x(n))$ is effective as compared with the use of the average value of the products $p(n)\times R_{max}(x(n))$ in that the use of the minimum value of the products $p(n)\times R_{max}(x(n))$ provides a high correct detection rate in detecting speech sections, for example.

Further, the product minimum value function obtains a minimum value of products $p(n)\times R_{max}(x(n))$ of the frame powers p(n) and the lag range maximum correlations $R_{max}(x(n))$ of N respective consecutive frames. The power minimum value function obtains a minimum value of the frame powers p(n) of the N respective consecutive frames. Thus, it can be said that the rise of not only the frame powers p(n) but also the lag range maximum correlations $R_{max}(x(n))$ is again effective as compared with the use of only the frame powers p(n) in that the use of not only the frame powers p(n) but also the lag range maximum correlations $R_{max}(x(n))$ provides a high correct detection rate in detecting speech sections, for example.

It is to be noted that speech processing that uses the lag range maximum correlation $R_{max}(y(n))$ of the noise-added signal Y(t) obtained by adding noise to an audio signal as input signal X(t) as a feature quantity of the audio signal is not limited to detection of speech sections. That is, the lag range maximum correlation $R_{max}(y(n))$ of a noise-added signal Y(t) can be used as a feature quantity of an audio signal in speech processing such for example as speech recognition, prosody recognition, and detection of fundamental frequency (pitch detection) as described in Non-Patent Document 7.

As described above, according to the noise mixing $R_{max}$ calculating process that obtains gain gain(n) as gain information indicating magnitude of noise g to be added to an input signal X(t) on the basis of lag range maximum correlation $R_{max}(x(n))$ as autocorrelation of the input signal X(t) and frame power p(n) as power, and obtains lag range maximum correlation $R_{max}(y(n))$ as autocorrelation of a noise-added signal Y(t) obtained by adding noise $C\times gain(n)\times g$ corresponding to the gain gain(n) to the input signal X(t) as a feature quantity of the input signal X(t), it is possible to obtain the lag range maximum correlation $R_{max}(y(n))$ as autocorrelation that can for example detect a section having periodicity in the input signal X(t), that is, for example a speech section of voiced sound in particular, with high accuracy.

In the method described in Non-Patent Document 6 mentioned above, for example, as a process of a first stage, a feature quantity using the autocorrelation of an input signal is obtained, speech sections and non-speech sections are roughly determined for the entire input signal on the basis of the feature quantity, and the level of Gaussian noise to be added to the input signal is determined using the variance of the input signal in a section judged to be a non-speech section. As a process of a second stage, lag range maximum correlation is obtained as a feature quantity using the autocorrelation of the noise-added signal obtained by adding the Gaussian noise having the level determined in the process in the first stage to the input signal.

That is, in the process of the first stage of the method described in Non-Patent Document 6, the entire input signal is processed to obtain the autocorrelation of the input signal and determine the level of Gaussian noise to be added to the input signal.

Thus, in the method described in Non-Patent Document 6, the feature quantity may not be obtained by the process of the second stage until the entire input signal is processed to obtain the autocorrelation of the input signal, so that a long time delay occurs before the feature quantity is obtained. Because real-tome performance is generally requisite for speech processing such as speech recognition and detection of speech sections, for example, using a feature quantity, the occurrence of a long time delay is not desirable.

On the other hand, in the noise mixing $R_{max}$ calculating process, when a minimum value of products $p(n)\times R_{max}(x(n))$ of the frame powers p(n) and the lag range maximum correlations $R_{max}(x(n))$ of N respective consecutive frames is determined by the function $F(p(n),R_{max}(x(n)))$ for obtaining a gain gain(n), a delay corresponding to the N frames occurs, but a long time delay as in processing the entire input signal X(t) does not occur. Thus, the noise mixing $R_{max}$ calculating process adopted as a process for obtaining a feature quantity used in speech processing requisite for real-tome performance such as speech recognition and detection of speech sections, for example, hardly affects the real-time performance.

In addition, because the method described in Non-Patent Document 6 determines the level of Gaussian noise to be added to an input signal from the entire input signal in the process of the first stage, the method described in Non-Patent Document 6 is not suitable for the processing of an input signal including a speech component or periodic noise that changes in level with time.

On the other hand, the noise mixing $R_{max}$ calculating process refers to only a section of N consecutive frames when determining a minimum value of products $p(n)\times R_{max}(x(n))$ of the frame powers p(n) and the lag range maximum correlations $R_{max}(x(n))$ of the N respective frames by the function $F(p(n),R_{max}(x(n)))$ for obtaining a gain gain(n). It is therefore possible to obtain lag range maximum correlation $R_{max}(y(n))$ that can detect, with high accuracy, a section having periodicity in the input signal X(t) including a speech component or periodic noise that changes in level with time.

While the above description has been made of a case where autocorrelation is used as periodicity information indicating periodicity, similar processing can be performed using YIN or the like.

As described above, the noise mixing $R_{max}$ calculating process obtains the lag range maximum correlation $R_{max}(y(n))$ of the noise-added signal Y(t) obtained by adding noise $C\times gain(n)\times g$ having magnitude corresponding to the gain gain(n) to an input signal X(t). However, Gaussian noise, for example, as noise added to the input signal X(t) has variations in characteristic thereof.

In obtaining the lag range maximum correlation $R_{max}(y(n))$ that can for example detect a section having periodicity in the input signal X(t) with high accuracy, it is important to use Gaussian noise with appropriate characteristics as Gaussian noise to be added to the input signal X(t).

Specifically, the Gaussian noise generating unit 17 in FIG. 3 generates Gaussian noise g of a number T of samples which number T is equal to the frame length T of the input signal X(t) as Gaussian noise to be added to the input signal X(t). The lag range maximum correlation $R_{max}(g)$ of the Gaussian noise g of a number T of samples as a maximum value $R_{max}(g)$ of the normalized autocorrelation $R(g,\tau)$ of the Gaussian noise g in a range of the lag $\tau$ corresponding to the fundamental frequency range is desirably a value close to zero.

That is, in order that the lag range maximum correlation $R_{max}(y(n))$ is a lag range maximum correlation $R_{max}(y(n))$ that can for example detect a section having periodicity in the input signal X(t) with high accuracy, it is necessary for the lag range maximum correlation $R_{max}(y(n))$ to be a value close to zero (to be ideally zero) in a non-speech section.

In order that the lag range maximum correlation $R_{max}(y(n))$ is a value close to zero in a non-speech section, the lag range maximum correlation $R_{max}(g)$ of the Gaussian noise g to be added to the input signal X(t) needs to be a value close to zero.

However, while the lag range maximum correlation $R_{max}(g)$ of the Gaussian noise g is a value close to zero when the number T of samples of the Gaussian noise g is sufficiently large, the lag range maximum correlation $R_{max}(g)$ of the Gaussian noise g may be varied and not be a value close to zero when the number T of samples of the Gaussian noise g is not sufficiently large.

Figure 15:
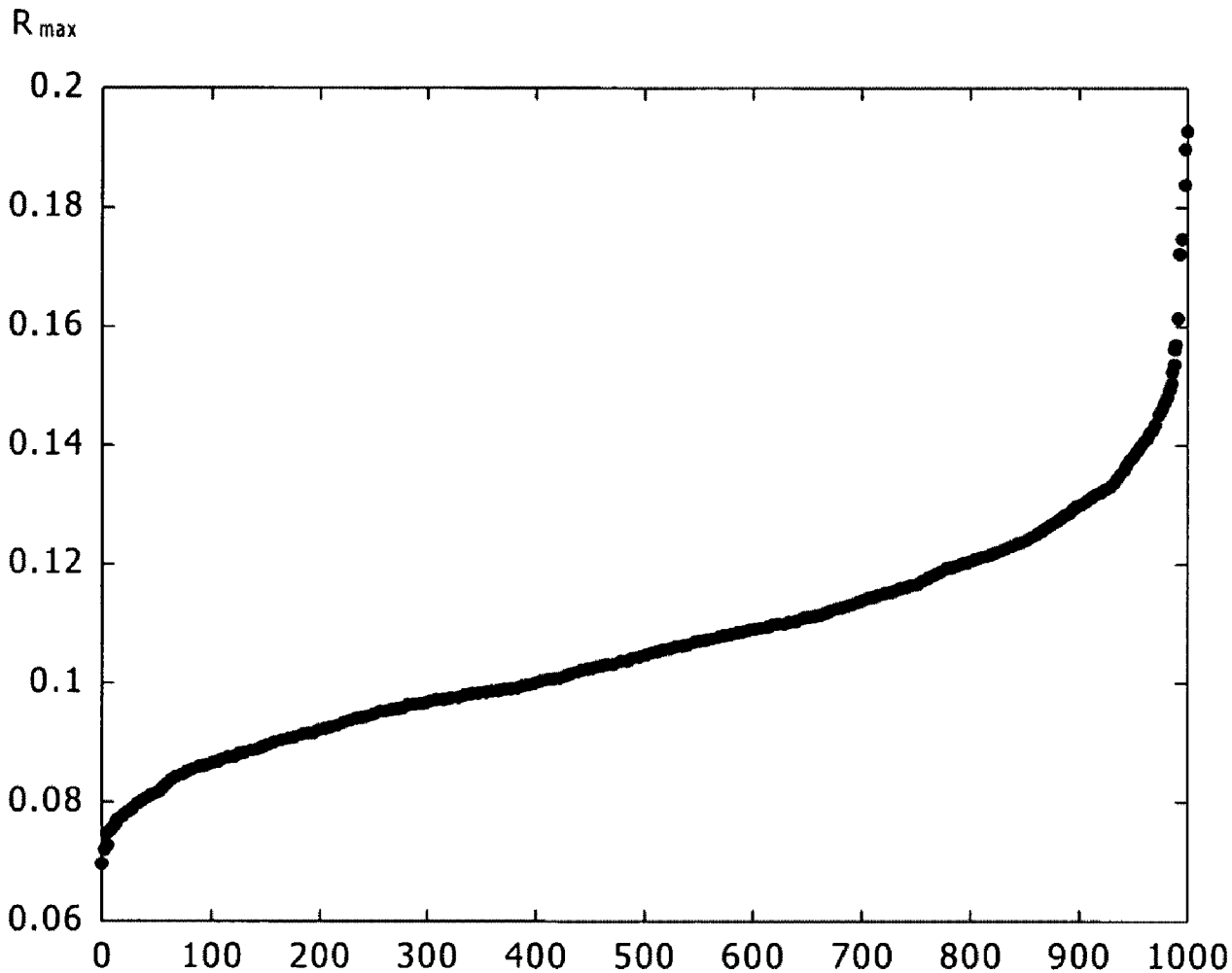
FIG. 15 is a diagram showing a distribution of the lag range maximum correlations $R_{max}(g)$ of Gaussian noises g.

FIG. 15 shows the lag range maximum correlation $R_{max}(g)$ of the Gaussian noise g.

Specifically, FIG. 15 shows the lag range maximum correlations $R_{max}(g)$ of 1000 Gaussian noises g which correlations are arranged in ascending order, the 1000 Gaussian noises g being obtained as a result of generating the Gaussian noise g as a different time series 1000 times when the number T of samples is 1024.

Incidentally, an axis of abscissas in FIG. 15 indicates ranking when the lag range maximum correlations $R_{max}(g)$ of the 1000 Gaussian noises g are arranged in ascending order. An axis of ordinates in FIG. 15 indicates the lag range maximum correlations $R_{max}(g)$ of the Gaussian noises g.

The respective lag range maximum correlations $R_{max}(g)$ of the 1000 Gaussian noises g are distributed in a range of about 0.07 to 0.2 and are varied.

Figure 16:
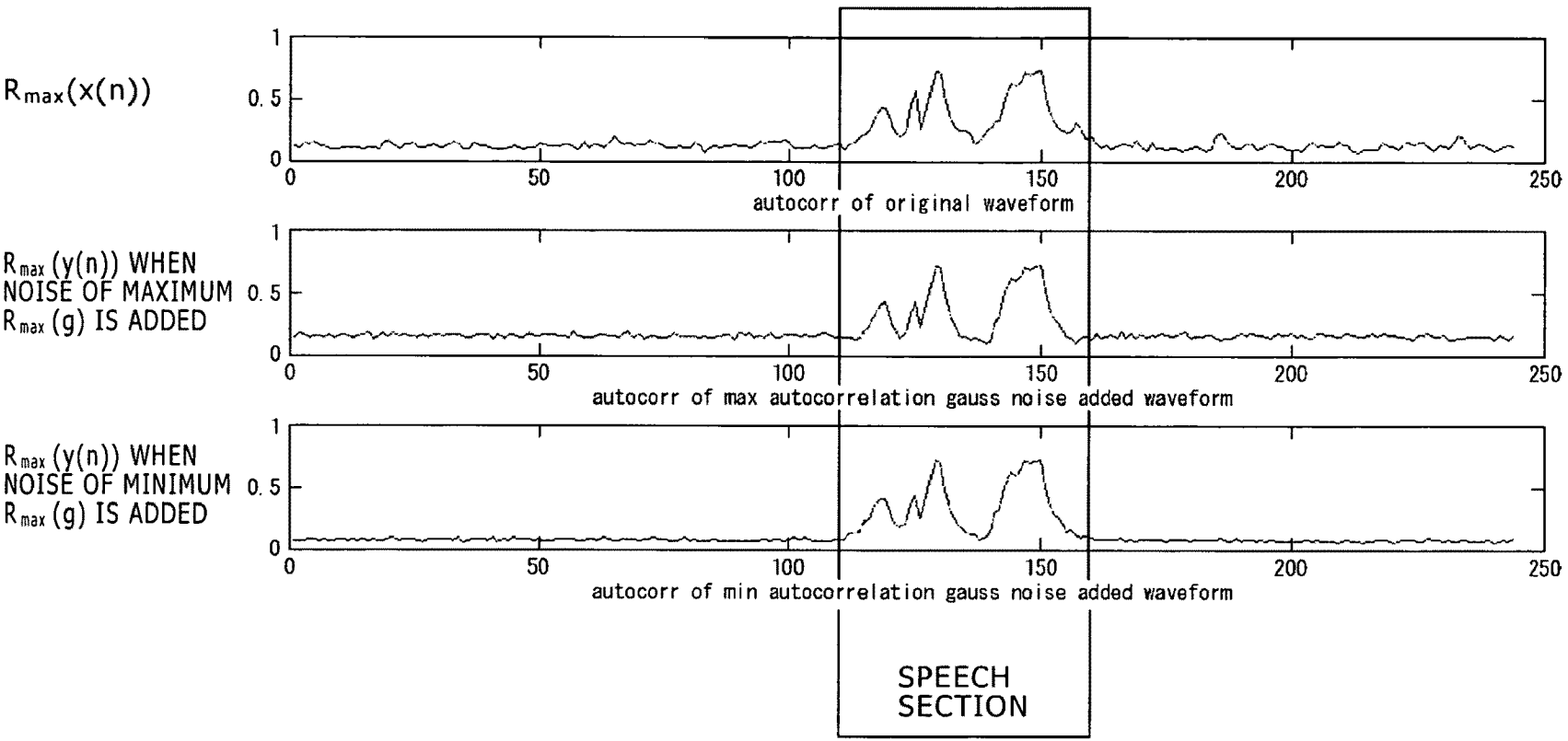
FIG. 16 is a waveform chart showing the lag range maximum correlation $R_{max}(y(n))$ of a noise-added signal Y(t)
Figure 17:
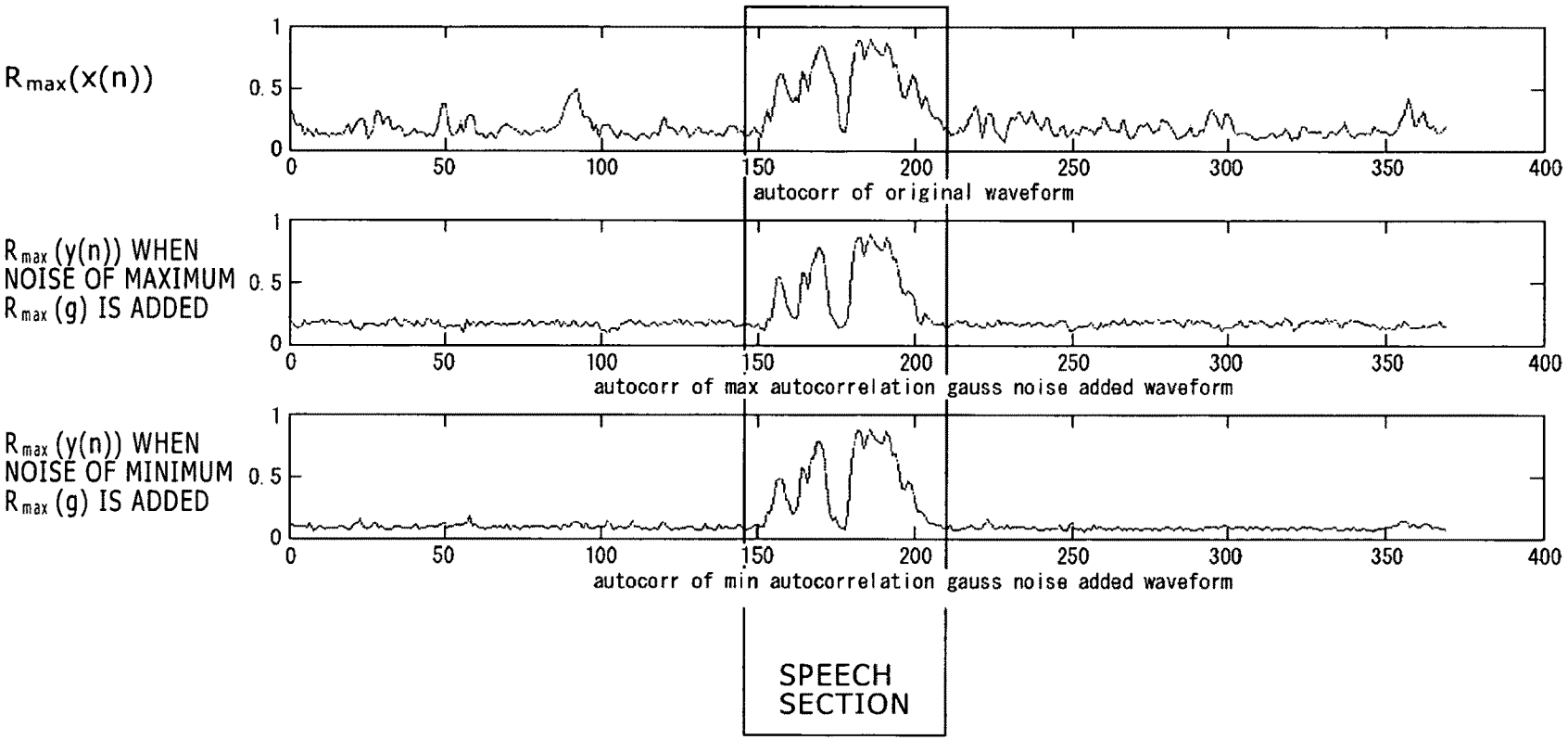
FIG. 17 is a waveform chart showing the lag range maximum correlation $R_{max}(y(n))$ of a noise-added signal Y(t)

FIG. 16 and FIG. 17 show the lag range maximum correlation $R_{max}(y(n))$ of a noise-added signal Y(t) obtained by adding a Gaussian noise $g_{max}$ having a maximum lag range maximum correlation $R_{max}(g)$ among the 1000 Gaussian noises g to an input signal X(t), and the lag range maximum correlation $R_{max}(y(n))$ of a noise-added signal Y(t) obtained by adding a Gaussian noise $g_{min}$ having a minimum lag range maximum correlation $R_{max}(g)$ among the 1000 Gaussian noises g to the input signal X(t).

Incidentally, an axis of abscissas in FIG. 16 and FIG. 17 indicates time (one unit of the axis of abscissas corresponds to 0.01 seconds). A part enclosed by a vertically long rectangle in FIG. 16 and FIG. 17 represents a speech section.

A first row from the top of FIG. 16 shows the lag range maximum correlation $R_{max}(x(n))$ of the input signal X(t).

A second row from the top of FIG. 16 shows the lag range maximum correlation $R_{max}(y(n))$ of the noise-added signal Y(t) obtained by adding the Gaussian noise $g_{max}$ having the maximum lag range maximum correlation $R_{max}(g)$ (0.2 mentioned with reference to FIG. 15) among the 1000 Gaussian noises g described above to the input signal X(t) shown in the first row. A third row from the top of FIG. 16 shows the lag range maximum correlation $R_{max}(y(n))$ of the noise-added signal Y(t) obtained by adding the Gaussian noise $g_{min}$ having the minimum lag range maximum correlation $R_{max}(g)$ (0.07 mentioned with reference to FIG. 15) among the 1000 Gaussian noises g described above to the input signal X(t) shown in the first row.

A first row from the top of FIG. 17 shows the lag range maximum correlation $R_{max}(x(n))$ of the input signal X(t) different from that of FIG. 16.

As with the second row from the top of FIG. 16, a second row from the top of FIG. 17 shows the lag range maximum correlation $R_{max}(y(n))$ of the noise-added signal Y(t) obtained by adding the Gaussian noise $g_{max}$ having the maximum lag range maximum correlation $R_{max}(g)$ to the input signal X(t) shown in the first row. As with the third row from the top of FIG. 16, a third row from the top of FIG. 17 shows the lag range maximum correlation $R_{max}(y(n))$ of the noise-added signal Y(t) obtained by adding the Gaussian noise $g_{min}$ having the minimum lag range maximum correlation $R_{max}(g)$ to the input signal X(t) shown in the first row.

It is clear from FIG. 16 and FIG. 17 that the lag range maximum correlation $R_{max}(g)$ of the Gaussian noise g added to the input signal X(t) greatly affects the lag range maximum correlation $R_{max}(y(n))$ of the noise-added signal Y(t) obtained by adding the Gaussian noise g to the input signal X(t).

Specifically, the lag range maximum correlation $R_{max}(y(n))$ of the noise-added signal Y(t) obtained by adding the Gaussian noise $g_{max}$ having the maximum lag range maximum correlation $R_{max}(g)$ to the input signal X(t) is high at about 0.2 in non-speech sections, as shown in the second row from the top of FIG. 16 and FIG. 17.

On the other hand, the lag range maximum correlation $R_{max}(y(n))$ of the noise-added signal Y(t) obtained by adding the Gaussian noise $g_{min}$ having the minimum lag range minimum correlation $R_{max}(g)$ to the input signal X(t) is low at about 0.07 in non-speech sections, as shown in the third row from the top of FIG. 16 and FIG. 17.

Hence, by adding a Gaussian noise having a lower lag range maximum correlation $R_{max}(g)$ to an input signal X(t), it is possible to obtain the lag range maximum correlation $R_{max}(y(n))$ of the noise-added signal Y(t) which correlation is a low value in a non-speech section, that is, the lag range maximum correlation $R_{max}(y(n))$ that can for example detect a section having periodicity in the input signal X(t) with high accuracy.

Accordingly, the Gaussian noise generating unit 17 in FIG. 3 can supply a Gaussian noise g having a lower lag range maximum correlation $R_{max}(g)$ to the noise mixing unit 18.

Figure 18:
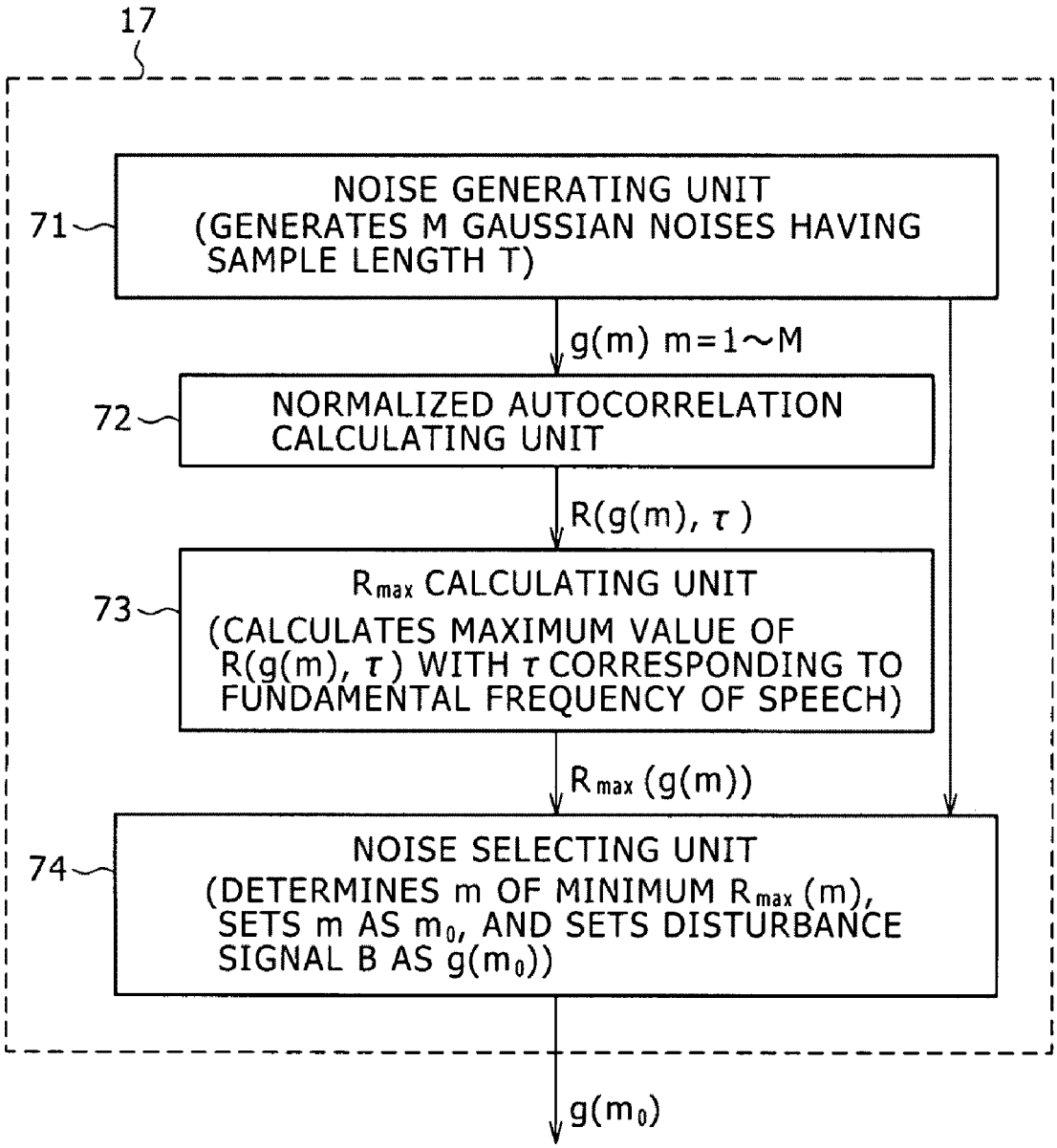
FIG. 18 is a block diagram showing an example of configuration of a Gaussian noise generating unit 17.

Specifically, FIG. 18 shows an example of configuration of the Gaussian noise generating unit 17 that supplies a Gaussian noise g having a lower lag range maximum correlation $R_{max}(g)$ to the noise mixing unit 18.

A noise generating unit 71 generates a plurality of M Gaussian noises g(1), g(2), . . . , and g(M) of different time series having samples equal in number to a frame length T. The noise generating unit 71 then supplies the M Gaussian noises to a normalized autocorrelation calculating unit 72 and a noise selecting unit 74.

The normalized autocorrelation calculating unit 72 obtains the normalized autocorrelation $R(g(m),\tau)$ of each of the M Gaussian noises g(m) (m=1, 2, . . . , M) supplied from the noise generating unit 71. The normalized autocorrelation calculating unit 72 then supplies the normalized autocorrelations $R(g(m),\tau)$ of the M Gaussian noises g(m) to a $R_{max}$ calculating unit 73.

The $R_{max}$ calculating unit 73 obtains a lag range maximum correlation $R_{max}(g(m))$ as a maximum value of each of the normalized autocorrelations $R(g(m),\tau)$ of the M Gaussian noises g(m) in a range of the lag $\tau$ corresponding to the fundamental frequency range, the normalized autocorrelations $R(g(m),\tau)$ of the M Gaussian noises g(m) being supplied from the normalized autocorrelation calculating unit 72. The $R_{max}$ calculating unit 73 then supplies the lag range maximum correlation $R_{max}(g(m))$ to the noise selecting unit 74.

The noise selecting unit 74 selects a Gaussian noise having a minimum lag range maximum correlation $R_{max}(g(m))$ supplied from the $R_{max}$ calculating unit 73 as autocorrelation of the Gaussian noise among the M Gaussian noises g(m) supplied from the noise generating unit 71. The noise selecting unit 74 then supplies the Gaussian noise as Gaussian noise g to be added to the input signal X(t) to the noise mixing unit 18 (FIG. 3).

A process performed in step S12 in FIG. 4 by the Gaussian noise generating unit 17 in FIG. 3, the Gaussian noise generating unit 17 having the configuration shown in FIG. 18, will next be described with reference to a flowchart in FIG. 19.

In step S51, the noise generating unit 71 generates M Gaussian noises g(m). The noise generating unit 71 then supplies the M Gaussian noises g(m) to the normalized autocorrelation calculating unit 72 and the noise selecting unit 74. The process proceeds to step S52.

In step S52, the normalized autocorrelation calculating unit 72 obtains the normalized autocorrelation $R(g(m),\tau)$ of each of the M Gaussian noises g(m) from the noise generating unit 71. The normalized autocorrelation calculating unit 72 then supplies the normalized autocorrelations $R(g(m),\tau)$ of the M Gaussian noises g(m) to the $R_{max}$ calculating unit 73. The process proceeds to step S53.

In step S53, the $R_{max}$ calculating unit 73 obtains a lag range maximum correlation $R_{max}(g(m))$ of each of the normalized autocorrelations $R(g(m),\tau)$ of the M Gaussian noises g(m) from the normalized autocorrelation calculating unit 72. The $R_{max}$ calculating unit 73 then supplies the lag range maximum correlation $R_{max}(g(m))$ to the noise selecting unit 74. The process proceeds to step S54.

In step S54, the noise selecting unit 74 selects a Gaussian noise having a minimum lag range maximum correlation $R_{max}(g(m))$ from the $R_{max}$ calculating unit 73 among the M Gaussian noises from the noise generating unit 71. The noise selecting unit 74 then supplies the Gaussian noise as Gaussian noise g to be added to the input signal X(t) to the noise mixing unit 18 (FIG. 3). The process returns to step S17 in FIG. 4.

Incidentally, it suffices for the Gaussian noise generating unit 17 to perform the process of steps S51 to S54 once and thereafter supply the Gaussian noise g selected in step S54 to the noise mixing unit 18.

In addition, while in FIG. 18 and FIG. 19, the Gaussian noise g to be supplied to the noise mixing unit 18 is selected from among the M Gaussian noises g(m) on the basis of the lag range maximum correlations $R_{max}(g(m))$ of the Gaussian noises g(m), the Gaussian noise g to be supplied to the noise mixing unit 18 can also be selected from among the M Gaussian noises g(m) on the basis of the lag range maximum correlations $R_{max}(y(n))$ of noise-added signals Y(t) obtained by adding the M respective Gaussian noises g(m) to the input signal X(t), for example.

Specifically, for example, an input signal X(t) for selection which signal is used to select the Gaussian noise g to be supplied to the noise mixing unit 18 is prepared in advance. The M lag range maximum correlations $R_{max}(y_m(n))$ of M respective noise-added signals $Y_m(t)$ obtained by adding the M respective Gaussian noises g(m) to the input signal X(t) for selection are obtained.

Then, a speech section of the input signal X(t) for selection is detected on the basis of the respective lag range maximum correlations $R_{max}(y_m(n))$ of the M noise-added signals $Y_m(t)$. A Gaussian noise g(m) added to a noise-added signal $Y_m(t)$ from which lag range maximum correlation $R_{max}(y_m(n))$ corresponding to a highest correct detection rate is obtained can be selected as Gaussian noise g to be supplied to the noise mixing unit 18 from among the M Gaussian noises g(m).

When the noise mixing $R_{max}$ calculating process performed in the signal processing device of FIG. 3 uses, as the function $F(p(n),R_{max}(x(n)))$ for obtaining the gain gain(n), the product minimum value function for obtaining a minimum value of products $p(n)\times R_{max}(x(n))$ of the frame powers p(n) and the lag range maximum correlations $R_{max}(x(n))$ of N respective consecutive frames or the produce average value function for obtaining an average value of the products $p(n)\times R_{max}(x(n))$, it is necessary to calculate autocorrelation twice. This is because the normalized autocorrelation calculating unit 13 needs to obtain the normalized autocorrelation R(x(n),τ) of the input signal X(t) and further the normalized autocorrelation calculating unit 19 needs to obtain the normalized autocorrelation R(y(n),τ) of the noise-added signal Y(t).

Thus, when the noise mixing $R_{max}$ calculating process is performed faithfully, so to speak, autocorrelation calculation needs to be performed twice. However, by making approximation, autocorrelation calculation needs to be performed once, and thereby an amount of calculation can be reduced.

Specifically, the lag range maximum correlation $R_{max}(x(n))$ of an nth frame of the input signal X(t) is obtained by the following equation.

[Equation 2] (2)

$$R_{\max}(x(n)) = \underset{\tau}{\operatorname{argmax}}\{R'\{x(n), t)/R'(x(n), 0)\}$$

In Equation (2), since R'(x(n),τ) is the pre-normalization autocorrelation of the frame x(n), and R'(x(n),0) is pre-normalization autocorrelation when the lag τ is zero, R'(x(n),τ)/R'(x(n),0) is the normalized autocorrelation of the frame x(n).

In Equation (2), argmax{ } with the lag τ attached under argmax{ } denotes a maximum value in braces { } in the range of the lag τ corresponding to the fundamental frequency range.

In addition, the lag range maximum correlation $R_{max}(y(n))$ of an nth frame y(n) of the noise-added signal Y(t) is obtained by the following equation similar to the above-described Equation (2) using the pre-normalization autocorrelation R'(y(n),τ) of the frame y(n) and the pre-normalization autocorrelation R'(y(n),0) when the lag τ is zero.

[Equation 3] (3)

$$R_{\max}(y(n)) = \underset{\tau}{\operatorname{argmax}}\{R'\{y(n), t)/R'(y(n), 0)\}$$

When noise of T samples equal in number to a frame length T which noise is added to the frame x(n) of the input signal X(t) to obtain the frame y(n) of the noise-added signal Y(t) in the noise mixing unit 18 in FIG. 3 is expressed as g(n), the frame y(n) of the noise-added signal Y(t) is expressed by an equation y(n)=x(n)+g(n).

Further, when a first sample value of the frame x(n) having the frame length T is expressed as x[t], a last sample value, for example, of the frame x(n) can be expressed as x[t+T−1]. Similarly, when a first sample value of the noise g(n) of the T samples is expressed as g[t], a last sample value, for example, of the noise g(n) can be expressed as g[t+T−1].

In this case, the pre-normalization autocorrelation R'(y(n),τ) on the right side of Equation (3) is expressed by Equation (4).

[Equation 4] (4)

$$R'(y(n), \tau) = \frac{1}{T}\sum_{i=t}^{t+T-1-\tau}\{x[i]+g[i]\}\{x[i+\tau]+g[i+\tau]\} = R'(x(n), \tau) + R'(g, \tau) + \frac{1}{T}\sum_{i=T}^{t+T-1-\tau}\{x[i]g[i+\tau]+x[i+\tau]g[i]\}$$

In this case, because of the wide range of the lag τ corresponding to the fundamental frequency range used in obtaining argmax{ } in Equation (2) and Equation (3), the pre-normalization autocorrelation R'(g(n),τ) of the noise g(n), which autocorrelation R'(g(n),τ) is a second term in a second row on the right side of Equation (4), can be approximated to zero.

In addition, because there is not correlation (it can be assumed that there is not correlation) between the noise g(n) and the frame x(n) of the input signal X(t), the cross-correlation $(1/T)\Sigma\{x[i]g[i+\tau]+x[i+\tau]g[i]\}$ between the noise g(n) and the frame x(n), which cross-correlation is a third term in the second row on the right side of Equation (4), can be approximated to zero.

Hence, the pre-normalization autocorrelation R'(y(n),τ) on the left side of Equation (4) can be approximated by an equation R'(y(n),τ)=R'(x(n),τ). That is, the pre-normalization autocorrelation R'(y(n),τ) of the frame y(n) of the noise-added signal Y(t) can be approximated by the pre-normalization autocorrelation R'(x(n) τ) of the frame x(n) of the input signal X(t).

By approximating the pre-normalization autocorrelation R'(y(n),τ) of the frame y(n) of the noise-added signal Y(t) by the pre-normalization autocorrelation R'(x(n)τ) of the frame x(n) of the input signal X(t) as described above, the normalized autocorrelation R(y(n),τ) of the frame y(n) of the noise-added signal Y(t), that is, the normalized autocorrelation R'(y(n),τ)/R'(y(n),0) (=R'(y(n),τ)/R'(x(n)+g(n),0) in argmax{ } on the right side of Equation (3) is expressed by the following equation.

[Equation 5] (5)

$$R(y(n), \tau) = R'\{y(n), \tau)/R'(y(n), 0) = R'(x(n), \tau)/\{R'(x(n), 0) + R'(g, (n), 0\} + \frac{1}{T}\sum_{i=T}^{t+T-1-\tau}\{x[i]g[i+\tau]+x[i+\tau]g[i]\}$$

Because there is not correlation between the noise g(n) and the frame x(n) of the input signal X(t) as described above, the cross-correlation $(1/T)\Sigma\{x[i]g[i+\tau]+x[i+\tau]g[i]\}$ between the noise g(n) and the frame x(n), which cross-correlation is a third term in a denominator in a second row on the right side of Equation (5), can be approximate to zero.

In this case, the normalized autocorrelation $R(y(n),\tau)$ of the frame y(n) of the noise-added signal Y(t) in Equation (5) can be approximated by an equation $R(y(n),\tau)=R'(x(n),\tau)/(R'(x(n),0)+R'(g(n)0))$.

$R'(g(n),0)$ in the denominator of the equation $R(y(n),\tau)=R'(x(n),\tau)/(R'(x(n),0)+R'(g(n)0))$ is the pre-normalization autocorrelation of the noise g(n) when the lag $\tau$ is zero. The pre-normalization autocorrelation $R'(g(n),0)$ when the lag $\tau$ is zero is equal to a sum total (square power) of squares of respective sample values of the noise g(n), and can thus be obtained without calculating the pre-normalization autocorrelation $R'(g(n),\tau)$ of the noise g(n).

As described above, the normalized autocorrelation $R(y(n),\tau)$ of the noise-added signal Y(t) can be approximated by the equation $R(y(n),\tau)=R'(x(n),\tau)/\{R'(x(n),0)+R'(g(n),0)\}$. By substituting the equation $R(y(n),\tau)=R'(x(n),\tau)/\{R'(x(n),0+R'(g(n),0)\}$ for $R'(y(n),\tau)/R'(y(n),0)$ in braces of argmax{ } in Equation (3), that is, for the normalized autocorrelation $R(y(n),\tau)$, the lag range maximum correlation $R_{max}(y(n))$ of the frame y(n) of the noise-added signal Y(t) in Equation (3) can be obtained according to an equation $R_{max}(y(n))=R_{max}(x(n))/\{R'(x(n),0)+R'(g(n),0)\}$ from the lag range maximum correlation $R_{max}(x(n))$ of the frame x(n) of the input signal X(t), the pre-normalization autocorrelation $R'(x(n),0)$ when the lag $\tau$ is zero, the pre-normalization autocorrelation $R'(x(n),0)$ being equal to the square power of the frame x(n), and the pre-normalization autocorrelation $R'(g(n),0)$ when the lag $\tau$ is zero, the pre-normalization autocorrelation $R'(g(n),0)$ being equal to the square power of the noise g(n).

That is, the lag range maximum correlation $R_{max}(y(n))$ of the noise-added signal Y(t) can be obtained without calculating the normalized autocorrelation $R(y(n),\tau)$ of the noise-added signal Y(t) by making approximations such that the autocorrelation of the noise g(n) and the cross-correlation between the input signal X(t) and the noise g(n) are zero, and using the lag range maximum correlation $R_{max}(x(n))$ as autocorrelation of the input signal X(t), the pre-normalization autocorrelation $R'(x(n),0)$ when the lag $\tau$ is zero, and the pre-normalization autocorrelation $R'(g(n),0)$ as autocorrelation of the noise g(n) when the lag is zero.

The noise mixing $R_{max}$ calculating process that obtains the lag range maximum correlation $R_{max}(y(n))$ of the noise-added signal Y(t) by approximation as described above will hereinafter be referred to as an approximation noise mixing $R_{max}$ calculating process. As for autocorrelation calculation in the approximation noise mixing $R_{max}$ calculating process, the calculation of the normalized autocorrelation $R(y(n),\tau)$ of the noise-added signal Y(t) is not necessary, and only the calculation of the normalized autocorrelation $R(x(n),\tau)$ of the input signal X(t) suffices, so that an amount of calculation can be reduced.

In order to differentiate the noise mixing $R_{max}$ calculating process performed by the signal processing device of FIG. 3 from the approximation noise mixing $R_{max}$ calculating process, the noise mixing $R_{max}$ calculating process performed by the signal processing device of FIG. 3 will hereinafter be referred to as a normal noise mixing $R_{max}$ calculating process is appropriate.

Figure 20:
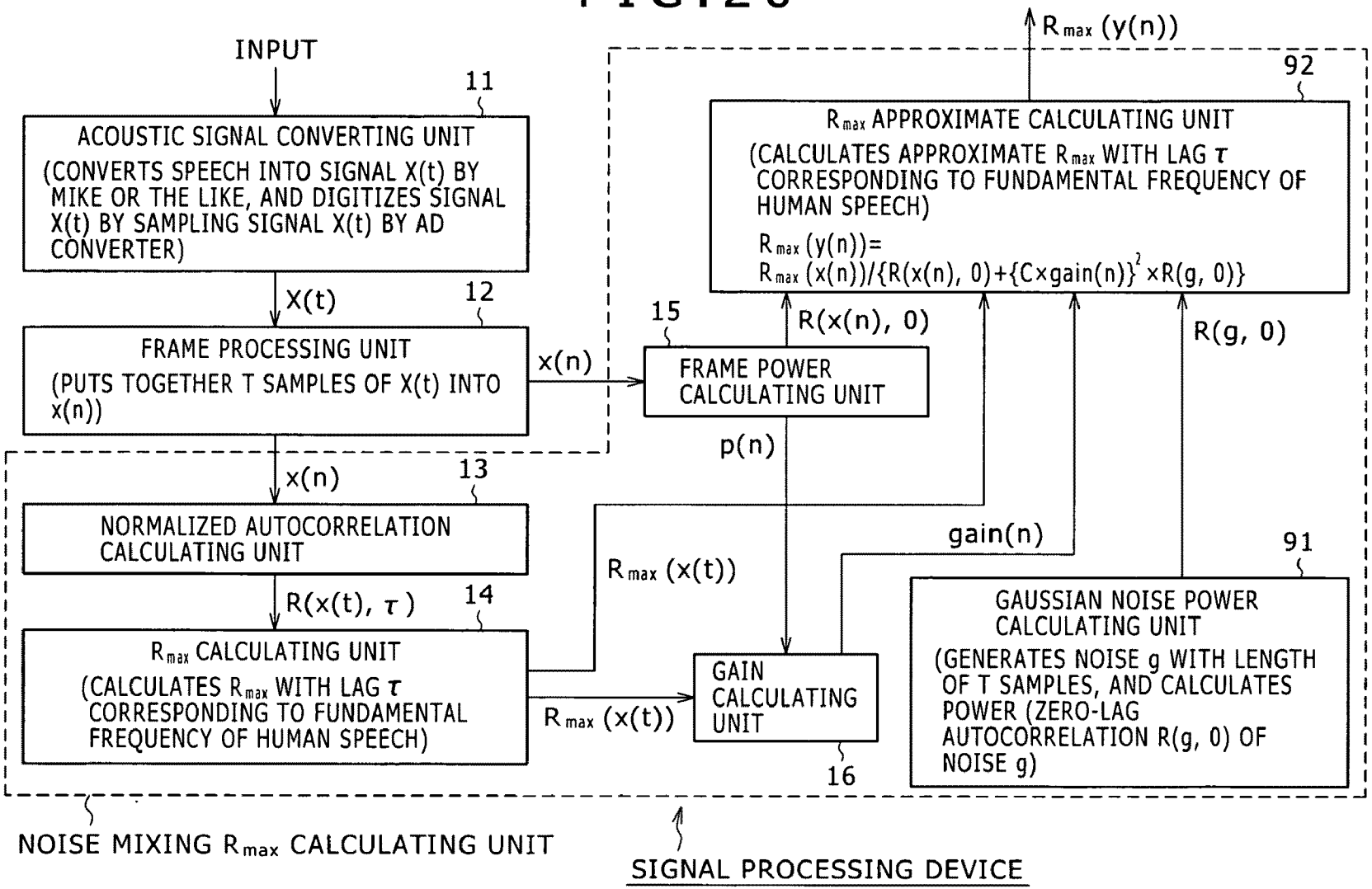
FIG. 20 is a block diagram showing an example of configuration of another embodiment of a signal processing device to which the present invention is applied.

FIG. 20 shows an example of configuration of one embodiment of a signal processing device that obtains the lag range maximum correlation $R_{max}(y(n))$ of a noise-added signal Y(t) as a feature quantity of an input signal X(t) by the approximation noise mixing $R_{max}$ calculating process.

Incidentally, in FIG. 20, parts corresponding to those of the signal processing device of FIG. 3 are identified by the same reference numerals, and description thereof will be omitted in the following as appropriate. Specifically, the signal processing device of FIG. 20 is formed in the same manner as the signal processing device of FIG. 3 except that the signal processing device of FIG. 20 has a Gaussian noise power calculating unit 91 in place of the Gaussian noise generating unit 17, has an $R_{max}$ approximate calculating unit 92 in place of the $R_{max}$ calculating unit 20, and does not have the noise mixing unit 18 and the normalized autocorrelation calculating unit 19.

In the signal processing device of FIG. 20, a normalized autocorrelation calculating unit 13, an $R_{max}$ calculating unit 14, a frame power calculating unit 15, a gain calculating unit 16, the Gaussian noise power calculating unit 91, and the $R_{max}$ approximate calculating unit 92 form a noise mixing $R_{max}$ calculating unit that performs the approximation noise mixing $R_{max}$ calculating process as a noise mixing $R_{max}$ calculating process.

The Gaussian noise power calculating unit 91 for example generates noise g of a number T of samples to be added to an input signal X(t), as with the Gaussian noise generating unit 17 in FIG. 3. The Gaussian noise power calculating unit 91 obtains the pre-normalization autocorrelation $R'(g,0)$ of the noise g when a lag $\tau$ is zero, that is, square power as a sum total of squares of respective sample values of the noise g. The Gaussian noise power calculating unit 91 then supplies the square power to the $R_{max}$ approximate calculating unit 92.

The $R_{max}$ approximate calculating unit 92 is not only supplied with the square power equal to the pre-normalization autocorrelation $R'(g,0)$ of the noise g when the lag $\tau$ is zero from the Gaussian noise power calculating unit 91 as described above, but also supplied with the lag range maximum autocorrelation $R_{max}(x(n))$ of a frame x(n) of the input signal X(t) from the $R_{max}$ calculating unit 14 and supplied with gain gain(n) from the gain calculating unit 16.

Further, the $R_{max}$ approximate calculating unit 92 is supplied with the frame power p(n) of the frame x(n) of the input signal X(t), that is, square power equal to the pre-normalization autocorrelation $R'(x(n),0)$ of the frame x(n) of the input signal X(t) when the lag $\tau$ is zero, from the frame power calculating unit 15.

Using the lag range maximum autocorrelation $R_{max}(x(n))$ of the frame x(n) of the input signal X(t) from the $R_{max}$ calculating unit 14, the pre-normalization autocorrelation $R'(x(n),0)$ of the frame x(n) of the input signal X(t) when the lag $\tau$ is zero from the frame power calculating unit 15, the gain gain(n) from the gain calculating unit 16, and the pre-normalization autocorrelation $R'(g,0)$ of the noise g when the lag $\tau$ is zero from the Gaussian noise power calculating unit 91, the $R_{max}$ approximate calculating unit 92 obtains the lag range maximum correlation $R_{max}(y(n))$ of a noise-added signal Y(t) obtained by adding noise $C\times gain(n)\times g$ having magnitude corresponding to the gain gain(n) to the input signal X(t) according to an expression $R_{max}(x(n))/\{R'(x(n),0)+\{C\times gain(n)\}^2\times R'(g,0)\}$ corresponding to the above-described equation $R_{max}(y(n)=R_{max}(x(n))/\{R'(x(n),0)+R'(g(n),0)\}$.

The operation of the signal processing device of FIG. 20 will next be described with reference to a flowchart of FIG. 21.

Figure 4:
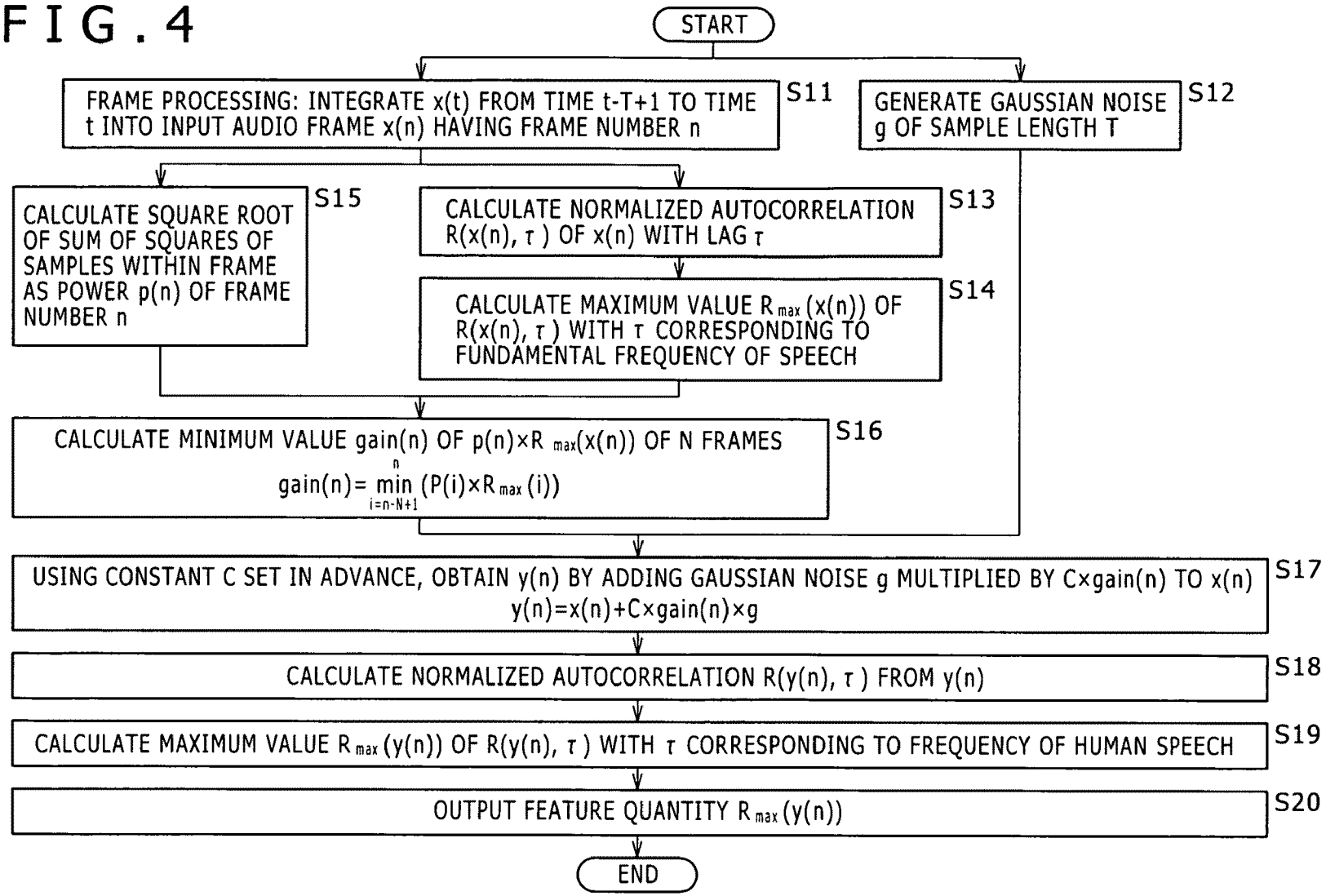
FIG. 4 is a flowchart of assistance in explaining the operation of the signal processing device.

In steps S91 and S93 to S96, the signal processing device of FIG. 20 performs the same processes as in steps S11 and S13 to S16, respectively, in FIG. 4.

Thereby, the $R_{max}$ calculating unit 14 obtains the lag range maximum correlation $R_{max}(x(n))$ of a frame x(n) of an input signal X(t). The frame power calculating unit 15 obtains the frame power p(n) of the input signal X(t). The gain calculating unit 16 obtains gain gain(n).

Then, the lag range maximum correlation $R_{max}(x(n))$ of the frame x(n) of the input signal X(t), the lag range maximum correlation $R_{max}(x(n))$ being obtained in the $R_{max}$ calculating unit 14, the frame power p(n) of the frame x(n) of the input signal X(t), the frame power p(n) being obtained in the frame power calculating unit 15, and the gain gain(n) obtained in the gain calculating unit 16 are supplied to the $R_{max}$ approximate calculating unit 92.

Meanwhile, in step S92, the Gaussian noise power calculating unit 91 generates for example Gaussian noise as noise g of T samples equal in number to the number of samples of one frame. The Gaussian noise power calculating unit 91 obtains the pre-normalization autocorrelation R'(g,0) of the noise g when a lag $\tau$ is zero, that is, the square power of the noise g. The Gaussian noise power calculating unit 91 then supplies the square power to the $R_{max}$ approximate calculating unit 92.

Then, in step S97, using the lag range maximum autocorrelation $R_{max}(x(n))$ of the frame x(n) of the input signal X(t) from the $R_{max}$ calculating unit 14, the frame power p(n) equal to the pre-normalization autocorrelation R'(x(n),0) of the frame x(n) of the input signal X(t) when the lag $\tau$ is zero from the frame power calculating unit 15, the gain gain(n) from the gain calculating unit 16, and the square power equal to the pre-normalization autocorrelation R'(g,0) of the noise g when the lag $\tau$ is zero from the Gaussian noise power calculating unit 91, the $R_{max}$ approximate calculating unit 92 obtains the lag range maximum correlation $R_{max}(y(n))$ of a noise-added signal Y(t) obtained by adding noise C×gain(n)×g having magnitude corresponding to the gain gain(n) to the input signal X(t) according to an equation $R_{max}(y(n))=R_{max}(x(n))/\{R'(x(n),0)+\{C\times gain(n)\}^2\times R'(g,0)\}$.

Further, the $R_{max}$ approximate calculating unit 92 in step S98 outputs the lag range maximum correlation $R_{max}(y(n))$ obtained in step S97 as a feature quantity extracted from the frame x(n) of the input signal X(t).

FIGS. 22 to 25 show the lag range maximum correlation $R_{max}(y(n))$ of the noise-added signal Y(t), the lag range maximum correlation $R_{max}(y(n))$ being obtained by the approximation noise mixing $R_{max}$ calculating process.

Incidentally, in FIGS. 22 to 25, the N frames for defining the function $F(p(n),R_{max}(x(n))$ for obtaining the gain gain(n) is 40 frames, and the constant C used to obtain the lag range maximum correlation $R_{max}(y(n))$ of the noise-added signal Y(t) is 0.2.

Parts enclosed by a rectangle in FIGS. 22 to 25 represent a speech section.

A first row from the top of each of FIGS. 22 to 25 shows an audio signal as the input signal X(t).

Figure 22:
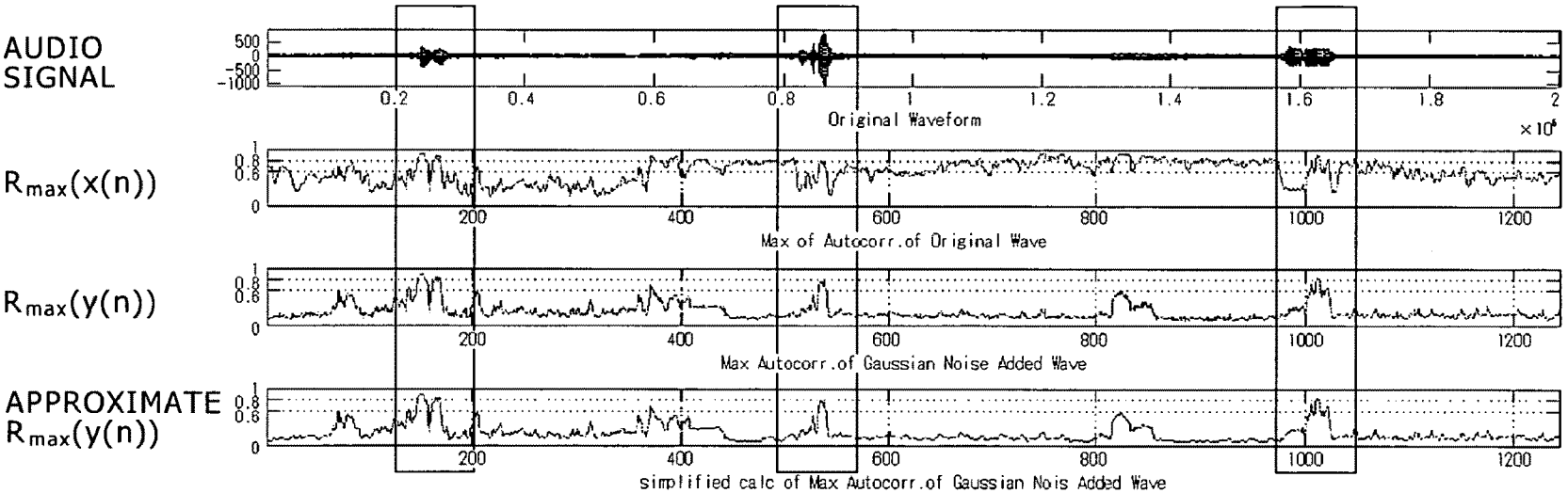
FIG. 22 is a waveform chart showing the lag range maximum correlation $R_{max}(y(n))$ of a noise-added signal Y(t)
Figure 23:
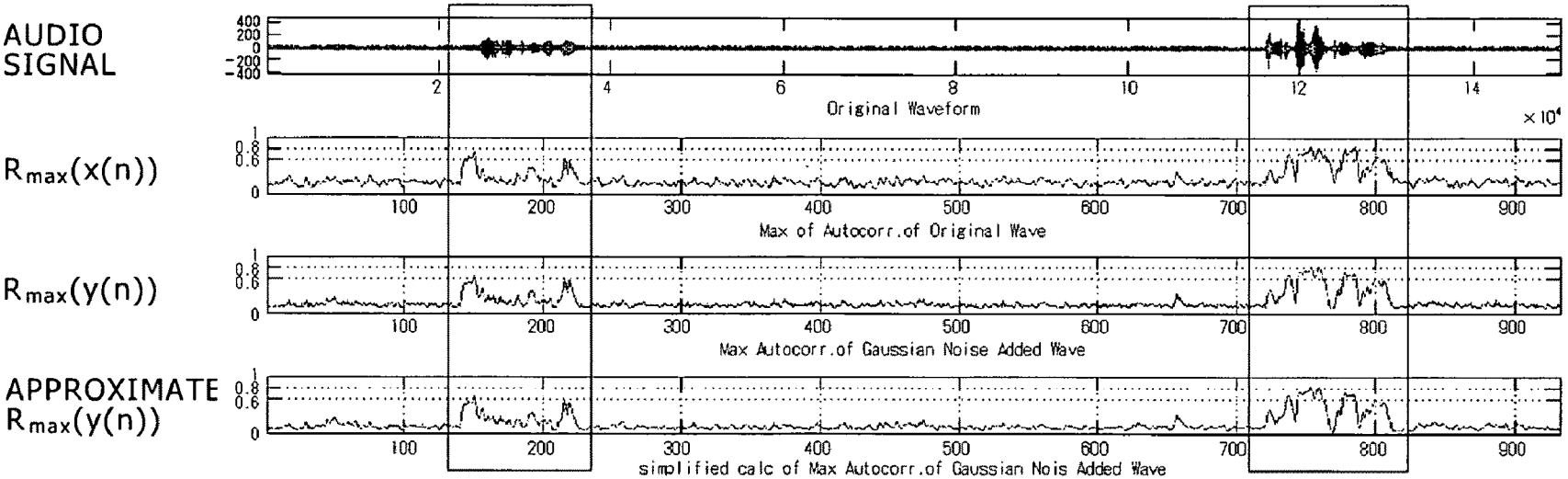
FIG. 23 is a waveform chart showing the lag range maximum correlation $R_{max}(y(n))$ of a noise-added signal Y(t)
Figure 24:
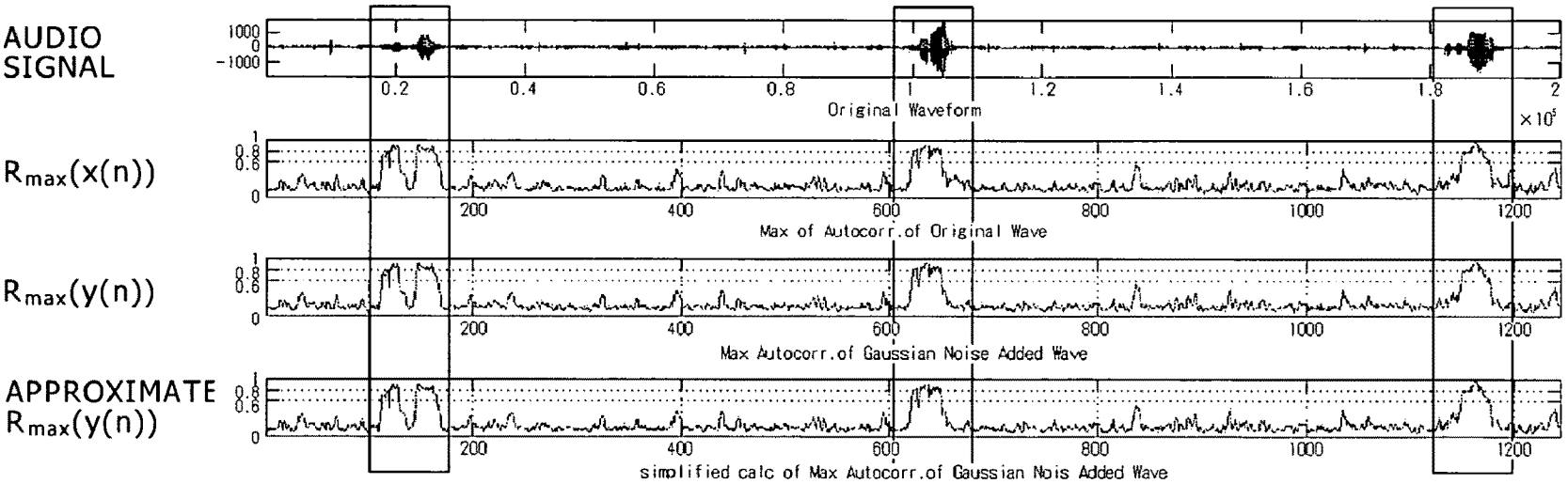
FIG. 24 is a waveform chart showing the lag range maximum correlation $R_{max}(y(n))$ of a noise-added signal Y(t)
Figure 25:
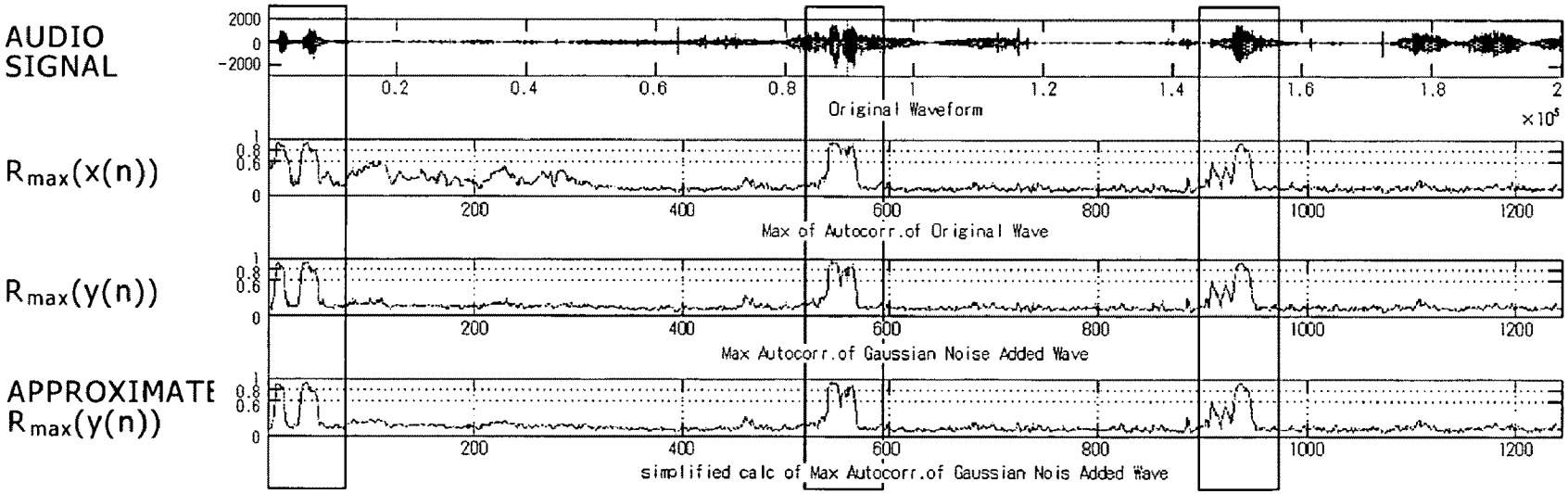
FIG. 25 is a waveform chart showing the lag range maximum correlation $R_{max}(y(n))$ of a noise-added signal Y(t)

Incidentally, the audio signal as the input signal X(t) in FIG. 22 is an audio signal obtained by collecting sound in the music environment. The audio signal obtained by collecting sound in the air conditioner environment. The audio signal as the input signal X(t) in FIG. 24 is an audio signal obtained by collecting sound in an environment in which a QRIO(R), which is a bipedal walking robot developed by Sony Corporation, was performing walking operation. The audio signal as the input signal X(t) in FIG. 25 is an audio signal obtained by collecting sound in an environment in which the QRIO(R) was dancing at high speed.

A second row from the top of each of FIGS. 22 to 25 shows the lag range maximum correlation $R_{max}(x(n))$ of the input signal X(t) shown in the first row. A third row from the top of each of FIGS. 22 to 25 shows the lag range maximum correlation $R_{max}(y(n))$ of the noise-added signal Y(t) which correlation is obtained from the input signal X(t) shown in the first row by the normal noise mixing $R_{max}$ calculating process.

A fourth row from the top of each of FIGS. 22 to 25 shows the lag range maximum correlation $R_{max}(y(n))$ of the noise-added signal Y(t) which correlation is obtained from the input signal X(t) shown in the first row by the approximation noise mixing $R_{max}$ calculating process.

The lag range maximum correlation $R_{max}(y(n))$ of the noise-added signal Y(t) which correlation is obtained by the approximation noise mixing $R_{max}$ calculating process in the fourth row from the top of each of FIGS. 22 to 25 substantially agrees with the lag range maximum correlation $R_{max}(y(n))$ of the noise-added signal Y(t) which correlation is obtained by the normal noise mixing $R_{max}$ calculating process in the third row from the top of each of FIGS. 22 to 25. It is thus understood that the approximation noise mixing $R_{max}$ calculating process is effective.

Incidentally, it is possible to adopt, as the function $F(p(n), R_{max}(x(n)))$ for obtaining the gain gain(n), not only the functions for obtaining a minimum value or an average value of products $p(n)\times R_{max}(x(n))$ of the frame powers p(n) and the lag range maximum correlations $R_{max}(x(n))$ of N respective consecutive frames including the frame x(n) but also a function for obtaining for example a median of the products $p(n)\times R_{max}(x(n))$.

The series of processes such as the above-described noise mixing $R_{max}$ calculating processes and the like can be carried out not only by hardware but also by software. When the series of processes is to be carried out by software, a program constituting the software is installed onto a general-purpose personal computer or the like.

Figure 26:
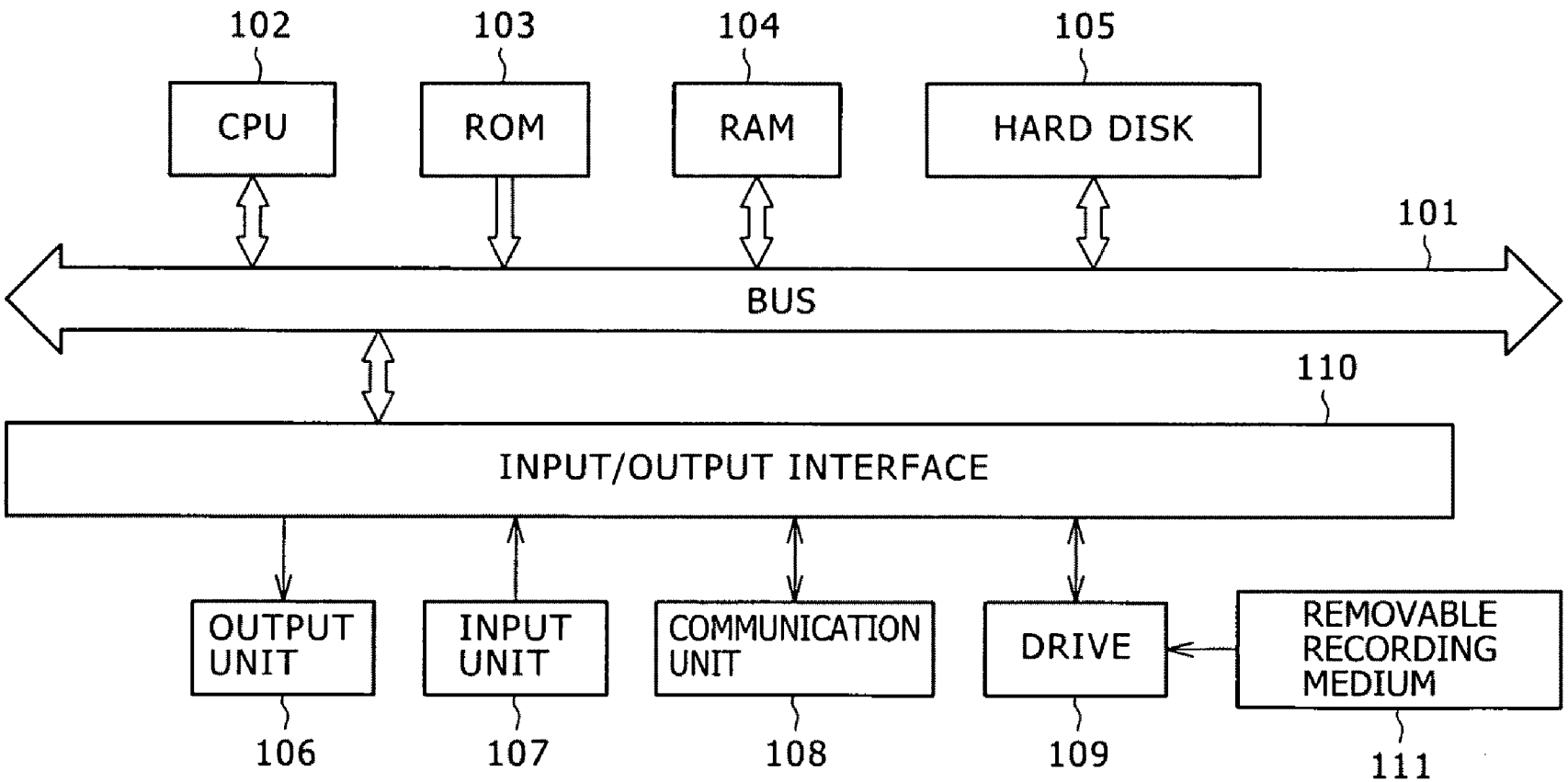
FIG. 26 is a block diagram showing an example of configuration of an embodiment of a computer to which the present invention is applied.

FIG. 26 shows an example of configuration of an embodiment of a computer on which the program for carrying out the above-described series of processes is installed.

The program can be recorded in advance on a hard disk 105 as a recording medium included in the computer or in a ROM 103.

Alternatively, the program can be stored (recorded) temporarily or permanently on a removable recording medium 111 such as a flexible disk, a CD-ROM (Compact Disk-Read Only Memory), an MO (Magneto-Optical) disk, a DVD (Digital Versatile Disk), a magnetic disk, a semiconductor memory or the like. Such a removable recording medium 111 can be provided as so-called packaged software.

Incidentally, in addition to being installed from the removable recording medium 111 as described above onto the computer, the program can be transferred from a download site to the computer by radio via an artificial satellite for digital satellite broadcasting, or transferred to the computer by wire via a network such as a LAN (Local Area Network), the Internet and the like, and the computer can receive the thus transferred program by a communication unit 108 and install the program onto the built-in hard disk 105.

The computer includes a CPU (Central Processing Unit) 102. The CPU 102 is connected with an input-output interface 110 via a bus 101. When a user inputs a command via the input-output interface 110 by for example operating an input unit 107 formed by a keyboard, a mouse, a microphone and the like, the CPU 102 executes a program stored in the ROM (Read Only Memory) 103 according to the command. Alternatively, the CPU 102 loads, into a RAM (Random Access Memory) 104, the program stored on the hard disk 105, the program transferred from the satellite or the network, received by the communication unit 108, and then installed onto the hard disk 105, or the program read from the removable recording medium 111 loaded in the drive 109 and then installed onto the hard disk 105. The CPU 102 then executes the program. The CPU 102 thereby performs the processes according to the above-described flowcharts or the processes performed by the configurations of the block diagrams described above. Then, as occasion demands, the CPU 102 for example outputs a result of the processes to an output unit 106 formed by an LCD (Liquid Crystal Display), a speaker and the like via the input-output interface 110, transmits the result from the communication unit 108, or records the result onto the hard disk 105.

In the present specification, the process steps describing the program for making a computer perform various processes do not necessarily have to be performed in time series in the order described in the flowcharts, and may include processes performed in parallel or individually (for example parallel processing or processing based on an object).

The program may be processed by one computer, or may be subjected to distributed processing by a plurality of computers. Further, the program may be transferred to a remote computer and then executed.

It is to be noted that embodiments of the present invention are not limited to the foregoing embodiments, and are susceptible of various changes without departing from the spirit of the present invention.

Specifically, while in the present embodiments, description has been made of a case where autocorrelation is used as periodicity information indicating periodicity, YIN, for example, can be used as other periodicity information. When YIN is used as periodicity information, it suffices to use 1-YIN in place of the above-described normalized autocorrelation, or to read a maximum value of normalized autocorrelation as a minimum value of YIN and read a minimum value of normalized autocorrelation as a maximum value of YIN.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing device for processing an input signal, said signal processing device comprising:

gain calculating means for obtaining gain information indicating magnitude of noise to be added to said input signal on a basis of periodicity information indicating periodicity of said input signal and power of said input signal; and feature quantity calculating means for obtaining periodicity information of a noise-added signal obtained by adding noise having magnitude corresponding to said gain information to said input signal as a feature quantity of said input signal.

2. The signal processing device according to claim 1, wherein said gain calculating means obtains one of a minimum value, a median, and an average value within a fixed time of values calculated from the periodicity information and the power of said input signal as said gain information.

3. The signal processing device according to claim 1, wherein said noise is Gaussian noise.

4. The signal processing device according to claim 1, wherein said periodicity information is autocorrelation, and said gain calculating means obtains said gain information on a basis of normalized autocorrelation of said input signal and the power of said input signal.

5. The signal processing device according to claim 1, wherein said periodicity information is autocorrelation, and said gain calculating means obtains said gain information on a basis of a maximum value of normalized autocorrelation of said input signal in a range of a lag corresponding to a specific frequency range and the power of said input signal.

6. The signal processing device according to claim 5, wherein said specific frequency range is a fundamental frequency range of speech of a human.

7. The signal processing device according to claim 1, further comprising:

noise generating means for generating a plurality of noises; and noise selecting means for selecting a noise to be added to said input signal from said plurality of noises on a basis of periodicity information of said noises.

8. The signal processing device according to claim 7, wherein said periodicity information is autocorrelation, and said noise selecting means selects the noise to be added to said input signal from among said plurality of noises on a basis of maximum values of normalized autocorrelations of said noises in a range of a lag corresponding to a specific frequency range.

9. The signal processing device according to claim 1, wherein said periodicity information is autocorrelation, and said feature quantity calculating means approximates autocorrelation of said noise and cross-correlation between said input signal and said noise to zero, and obtains an approximate value of normalized autocorrelation of said noise-added signal as the feature quantity of said input signal, using autocorrelation of said input signal and autocorrelation of said noise when a lag is zero.

10. The signal processing device according to claim 1, further comprising processing means for performing predetermined processing on a basis of the feature quantity of said input signal.

11. The signal processing device according to claim 10, wherein said feature quantity calculating means obtains the feature quantity of said input signal for each frame having a fixed time length, said signal processing device further includes plural frame processing means for obtaining an integrated feature quantity of a plurality of dimensions, said integrated feature quantity being obtained by integrating feature quantities of a plurality of frames, and said processing means performs the predetermined processing on a basis of said integrated feature quantity.

12. The signal processing device according to claim 11, further comprising linear discriminant analysis means for compressing the dimensions of said integrated feature quantity by linear discriminant analysis, wherein said processing means performs the predetermined processing on a basis of said integrated feature quantity of the compressed dimensions.

13. The signal processing device according to claim 1, wherein said input signal is an audio signal, and said processing means performs one of speech section detection, speech recognition, prosody recognition, and fundamental frequency detection on a basis of a feature quantity of said audio signal.

14. The signal processing device according to claim 1, wherein said periodicity information is YIN, and said gain calculating means obtains said gain information on a basis of the YIN of said input signal and the power of said input signal.

15. The signal processing device according to claim 1, wherein said periodicity information is YIN, and said gain calculating means obtains said gain information on a basis of a minimum value of the YIN of said input signal in a range of a lag corresponding to a specific frequency range and the power of said input signal.

16. The signal processing device according to claim 15, wherein said specific frequency range is a fundamental frequency range of speech of a human.

17. The signal processing device according to claim 7, wherein said periodicity information is YIN, and said noise selecting means selects the noise to be added to said input signal from among said plurality of noises on a basis of minimum values of the YIN of said noises in a range of a lag corresponding to a specific frequency range.

18. A signal processing method of a signal processing device for processing an input signal, said signal processing method comprising the steps of:

obtaining gain information indicating magnitude of noise to be added to said input signal on a basis of periodicity information indicating periodicity of said input signal and power of said input signal; and obtaining periodicity information of a noise-added signal obtained by adding noise having magnitude corresponding to said gain information to said input signal as a feature quantity of said input signal.

19. A program, stored on a computer storage device, for making a computer perform signal processing that processes an input signal, said signal processing comprising the steps of:

obtaining gain information indicating magnitude of noise to be added to said input signal on a basis of periodicity information indicating periodicity of said input signal and power of said input signal; and obtaining periodicity information of a noise-added signal obtained by adding noise having magnitude corresponding to said gain information to said input signal as a feature quantity of said input signal.

20. A signal processing device for processing an input signal, said signal processing device comprising:

a gain calculator configured to obtain gain information indicating magnitude of noise to be added to said input signal on a basis of periodicity information indicating periodicity of said input signal and power of said input signal; and a feature quantity calculator configured to obtain periodicity information of a noise-added signal obtained by adding noise having magnitude corresponding to said gain information to said input signal as a feature quantity of said input signal.

* * * * *